US007370930B2

(12) United States Patent
Kosugi

(10) Patent No.: US 7,370,930 B2
(45) Date of Patent: May 13, 2008

(54) NON-CONTACT COMMUNICATION BETWEEN DEVICE AND CARTRIDGE CONTAINING CONSUMABLE COMPONENT

(75) Inventor: Yasuhiko Kosugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/303,258

(22) Filed: Nov. 25, 2002

(65) Prior Publication Data

US 2003/0128248 A1 Jul. 10, 2003

(30) Foreign Application Priority Data

Nov. 28, 2001 (JP) ..... 2001-362745
Nov. 28, 2001 (JP) ..... 2001-362746
Jun. 5, 2002 (JP) ..... 2002-164740

(51) Int. Cl.
*B41J 29/393* (2006.01)
*B41J 2/175* (2006.01)

(52) U.S. Cl. ..... 347/19

(58) Field of Classification Search ..... 347/19, 347/50, 86; 399/12
See application file for complete search history.

(56) References Cited

U.S. PATENT DOCUMENTS 5,485,188 A * 1/1996 Tochihara et al. ..... 347/43
5,610,635 A * 3/1997 Murray et al. ..... 347/19
6,196,670 B1 * 3/2001 Saruta ..... 347/86
6,302,527 B1 * 10/2001 Walker ..... 347/50
6,312,106 B1 * 11/2001 Walker ..... 347/50
6,366,742 B1 * 4/2002 Reihl et al. ..... 399/12
6,467,888 B2 * 10/2002 Wheeler et al. ..... 347/85
6,568,775 B2 * 5/2003 Zaremba ..... 347/5
2002/0015066 A1 * 2/2002 Siwinski et al. ..... 347/19

FOREIGN PATENT DOCUMENTS

| | | | |
|---|---|---|---|
| DE | 199 54 749 | A1 | 5/2001 |
| EP | 1 060 895 | A | 12/2000 |
| EP | 1 088 668 | A1 | 4/2001 |
| FR | 2 744 391 | | 8/1997 |
| GB | 2 354 735 | A | 4/2001 |
| JP | 11-203428 | A | 7/1999 |
| JP | 11-306297 | A | 11/1999 |
| WO | WO-98/04414 | A1 | 2/1998 |

* cited by examiner

*Primary Examiner*—Julian D. Huffman
(74) *Attorney, Agent, or Firm*—Stroock & Stroock & Lavan LLP

(57) ABSTRACT

The ink unit of a printer has a memory circuit (memory element) for non-contact communication. The memory circuit has a hold mode M2 in which memory access commands from the transmitter/receiver are not received, and an active mode M4 in which memory access is permitted upon receipt of a memory access command. The memory circuit shifts into active mode M4 if the ID contained in the active mode command matches its own ID when an active mode command containing the cartridge ID is received from the transmitter/receiver while in hold mode M2. The reception of an anti-collision start command from the transmitter/receiver while in hold mode M2 results in a shift to anti-collision mode M3 to check the ID.

32 Claims, 16 Drawing Sheets

S110
Non-access state

S111
INC1 access state

S112
INC2 access state

S113
INC3 access state

S116
INC6 access state

S220
Non-access state

S221
INC1, 2 access state

S222
INC3, 4
access state

S223
INC5, 6
access state

NON-CONTACT COMMUNICATION BETWEEN DEVICE AND CARTRIDGE CONTAINING CONSUMABLE COMPONENT

BACKGROUND OF THE INVENTION

1. Field of the Invention

The present invention relates to technology for non-contact communication between a device such as a printer and a cartridge containing a consumable component such as an ink.

2. Description of the Related Art

After being opened, for example, after a period of about six months, the quality of the ink in ink units (ink cartridges) for ink jet printers may deteriorate as a result of the environment in which it is used. Owing to such ink deterioration, high printing quality thus may not be achieved sometimes, and the print head of the printer may be adversely affected. An example of a way to deal with this problem is to provide the ink unit with a memory device such as an EEPROM, and to make sure that data for specifying the expiration period of the ink is stored in memory. A transmitter/receiver provided in the printer main unit can communicate with the memory through contact terminals to read the data concerning the expiration period of the ink. In addition to data related to the expiration period, data such as that relating to the amount of ink remaining in each ink unit may also be stored. The contact terminals may, however, become dirty, interfering with the transmission of data from the ink unit, and the need for precise alignment between the contact terminals on the ink unit and contact structure in the printer main unit complicates printer main unit construction.

An alternative to the contact type memory such as EEPROM is a structure in which a non-contact type of memory element is provided, and radio transmission is managed by a read/write sensor provided in the printer main unit.

However, because of the substantial distance over which radio transmission occurs, radio transmissions involving the use of non-contact type memory elements can result in the accidental reading of data in nearby memory elements different from the intended memory element, that is, signals can be mixed. In the case of color ink jet printers, for example, a plurality of different ink units for a plurality of different color inks are arranged at a short pitch from each other on a carriage (ink unit support member), and because the transmitted radio waves reach several of the ink units, there sometimes occurs erroneous communication with an adjacent ink unit instead of the intended ink unit.

Attempts have been made to pre-store ID information unique to each non-contact memory element, and to have the ID information first read by the printer main unit, so as to ensure proper communication as each element was distinguished through the use of the ID information during subsequent communication. However, since the procedure for reading the ID information includes a process for preventing mixed signals, referred to as an anti-collision process, running the ID information reading process for every communication process on each unit can result in a much longer communication process overall. This is undesirable, as it may degrade printer performance.

SUMMARY OF THE INVENTION

Accordingly, an object of the present invention is to provide a technique permitting more rapid non-contact communication between a printing device and a cartridge containing a consumable component.

In order to attain at least some of the above and other related objects, there is provided a device in which a cartridge housing a consumable component can be installed. The device includes a cartridge holder in which one or more cartridges each containing a consumable component can be mounted; and a transmitter/receiver capable of non-contact communication while near the cartridge. The cartridge has a memory circuit having an antenna for non-contact communication while near the transmitter/receiver, a memory for storing data relating to the consumable component, and a controller for controlling communication with the transmitter/receiver and for controlling access to the memory. The memory circuit has an anti-collision mode in which the transmitter/receiver checks the ID of the cartridge, and an active mode permitting memory access upon reception of a memory access command from the transmitter/receiver. The memory circuit can shift from a state which is not in anti-collision mode to active mode without passing through the anti-collision mode.

In this structure, the memory circuit can shift to memory access mode without passing through the anti-collision mode for checking the ID, thus permitting more rapid non-contact communication than the conventional devices, thereby improving performance.

According to an aspect of the present invention, the device is a printer in which a plurality of ink units each equipped with an element capable of storing data are to be mounted. The printer includes an ink unit support member for supporting the plurality of ink units, and a communication device for reading or writing data upon non-contact communication with the element. The printer is characterized by a first procedure in which, for each ink unit, the communication device communicates with an element provided in the ink unit to read ID information stored in the element, and a second procedure in which the communication device communicates with the element provided in the ink unit supported by the ink unit support member while distinguishing the element based on the ID information that has been read. The second procedure is run without the first procedure being run if the ID information stored in the element provided in the ink unit has already been properly read when the communication device starts communicating with the element, so that the communication device communicates with the element.

Accidental communication with other elements can be prevented in this printer because, for each ink unit, the communication device reads the ID information stored in the element in the ink unit in the first procedure, and communicates with the element in the second procedure while the element is distinguished based on the ID information, so that the ID information stored in the element can be used to check if the communication is being made with a specific proper element.

Also, the second procedure is run without the first procedure being run if the ID information stored in the element provided in the cartridge has already been properly read when the communication device starts communicating with the element, so that the communication device communicates with the element, thus shortening the time needed for the communication process when the ID information has already been properly read other than when powered on or the like.

The present invention may be realized in a variety of embodiments, such as devices in which cartridges containing a consumable component can be mounted; cartridges containing a consumable component; memory elements or memory circuits for cartridges containing a consumable component; printing devices (printers), computer systems having a device in which cartridges containing a consumable component can be mounted; methods for operating such various devices, systems, or memory elements; computer programs for implementing the functions of such various devices, systems, or memory elements; recording media on which such computer programs are recorded; and data signals embodied in a carrier wave including the computer program.

These and other objects, features, aspects, and advantages of the present invention will become more apparent from the following detailed description of the preferred embodiments when considered with reference to the accompanying drawings.

DESCRIPTION OF THE PREFERRED EMBODIMENT

Preferred embodiments of the invention are described below in the following order.

Figure 1:
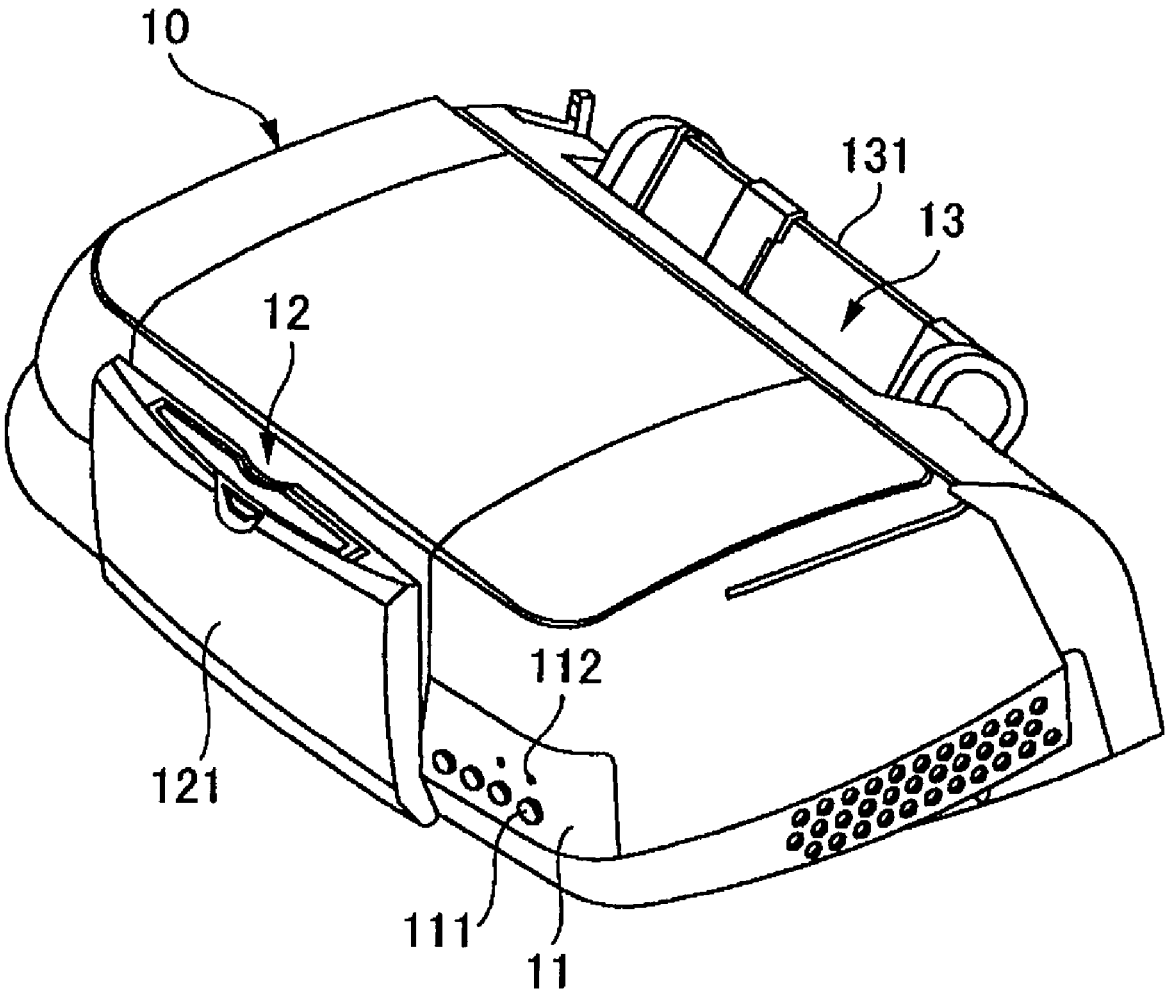
FIG. 1 is a perspective view showing the exterior of an ink jet printer.

A. Outline of ink jet printer
B. Structure of carriage and surroundings
C. Structure of memory element and transmitter/receiver
D. Internal structure of ink jet printer
E. Internal structure of control circuit
F. Operation of ink jet printer
G. Details of anti-collision process
H. Details of memory access process
I. Variants in flow of communication between printer main unit and memory element
J: Other variants A. Outline of Ink Jet Printer An outline of an ink jet printer as the primary applicable printing device in an embodiment of the present invention is described below. FIG. 1 is a perspective viewing showing the exterior of such an ink jet printer.

A color ink jet printer is illustrated in FIG. 1. The color printer 10, which is an ink jet printer capable of producing color images, is an ink jet type of printer in which a total of six colors, including light cyan (LC) and light magenta (LM) in addition to the four standard ink colors of cyan (C), magenta (M), yellow (Y), and black (K) are ejected onto a printing object (printing medium) such as cut paper to form ink dots, thereby forming an image. Printers using ink sets of number other than six, such as the standard four color ink set, may also be employed.

As illustrated in FIG. 1, the color printer 10 includes a paper-feed structure in which the printing object such as cut paper is fed from above and in back is ejected from the front. An operating panel 11 and a paper ejector 12 are provided in the front of the printer main unit 10, and a paper feeder 13 is provided in back. By way of non-limiting example, the operating panel 11 includes various operation buttons such as an ink unit replacement button 111, and a display lamp 112. The paper ejector 12 is provided with a paper ejector tray 121 that covers the paper ejector opening when not in use. The paper feeder 13 is provided with a privotable paper feed tray 131 that holds the cut paper (not shown). The printer 10 may also be provided with a paper feed structure which permits not only single sheets of a printing objects such as cut paper, but also continuous printing medium such as paper rolls, and media such as film or textiles to be printed.

B. Structure of Carriage and Surroundings

Figure 2:
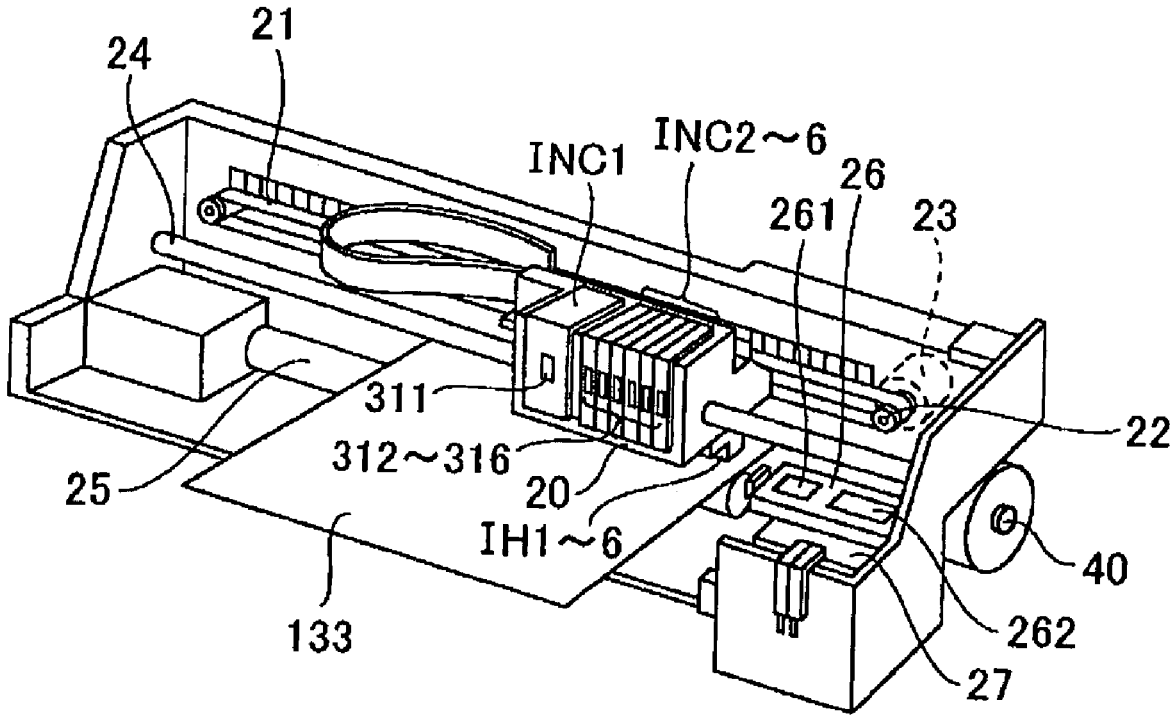
FIG. 2 is a perspective view showing the internal components in the vicinity of the carriage of the ink jet printer.

The structure of the carriage 20 and its surroundings with regard to the ink unit support member (or cartridge holder) inside the color printer 10. FIG. 2 is a perspective view illustrating the structure of the surroundings of the carriage 20. The carriage 20 is connected to a carriage motor 23 by a pulley 22 through a drive belt 21, and is driven so as to travel horizontal to a platen 25 along a guide shaft 24.

An ink unit (ink cartridge) INC1 containing black ink, and five ink units INC2 through INC6 containing five colors of ink are mounted on the carriage 20. The bottom of the carriage 20 facing the printing paper is provided with a print head IH1 having a nozzle row for ejecting black ink and print heads IH2 through IH6 having nozzle rows for ejecting five colors of ink, respectively. The nozzle rows are fed ink from the ink units INC1 through INC6, respectively, to eject ink droplets onto the printing paper so as to print text or images.

The non-printing area on the right side within the movable range of the carriage 20 is provided with a capping device 26 for sealing the nozzle openings of the heads IH1 through IH6 when not printing, and a pump unit 27 has a pump motor (not shown in figure). When the carriage 20 moves from the printing area into the non-printing area on the right side, the carriage 20 comes into contact with a lever (not shown in figure), and the capping device 26 moves upward to seal the heads IH1 through IH6.

In cases where some nozzle openings of heads IH1 through IH6 become plugged, or in cases where it is necessary to forcibly eject ink from the heads IH1 through IH6 when one or more ink units are replaced, the pump unit 27 is operated while heads IH1 through IH6 are sealed by the caps 261 and 262, and the ink is suctioned out of the nozzle openings by the negative pressure generated by the pump unit 27. In this way, dust or paper particles adhering around the nozzle opening arrays can be cleaned off, and air bubbles inside the heads IH1 through IH6 can be removed along with the ink on the caps 261 and 262.

Memory elements 311 through 316 capable of storing data are provided individually on the surface in front (relative to the direction in which paper is ejected) of each ink unit INC1 through INC6. Although not shown in FIG. 2, a transmitter/receiver serving as the communication device for reading or writing data is provided, so as to face opposite the memory elements, at a suitable location in the non-printing area on the left side within the movable range of the carriage 20.

Figure 3A:
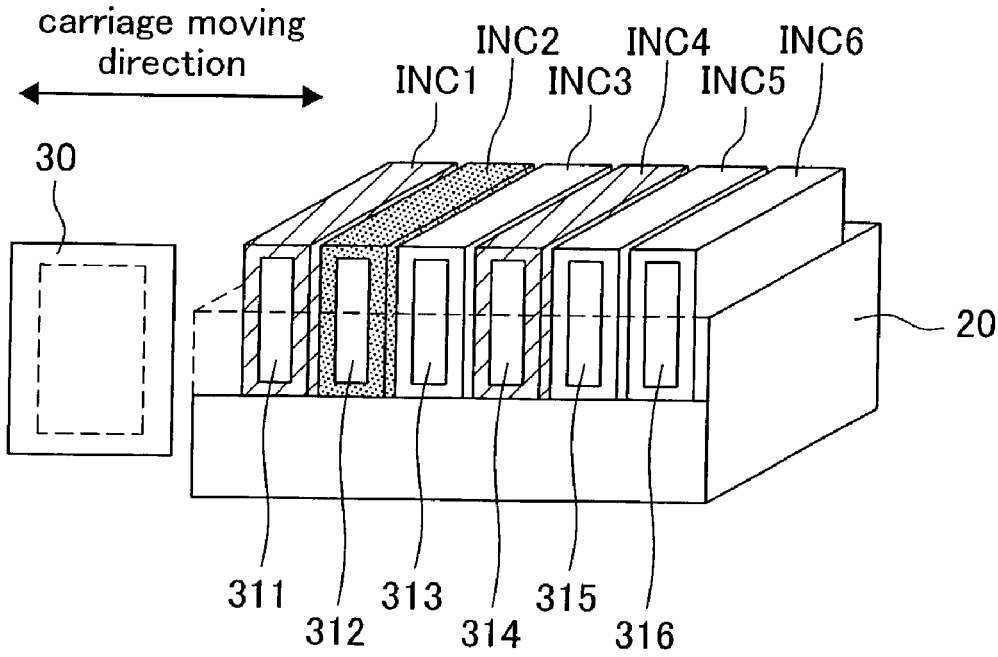
FIGS. 3(*a*) and 3(*b*) schematically illustrate the positional relationship between the memory elements of the ink units and the transmitter/receiver in the printer main unit.
Figure 3B:
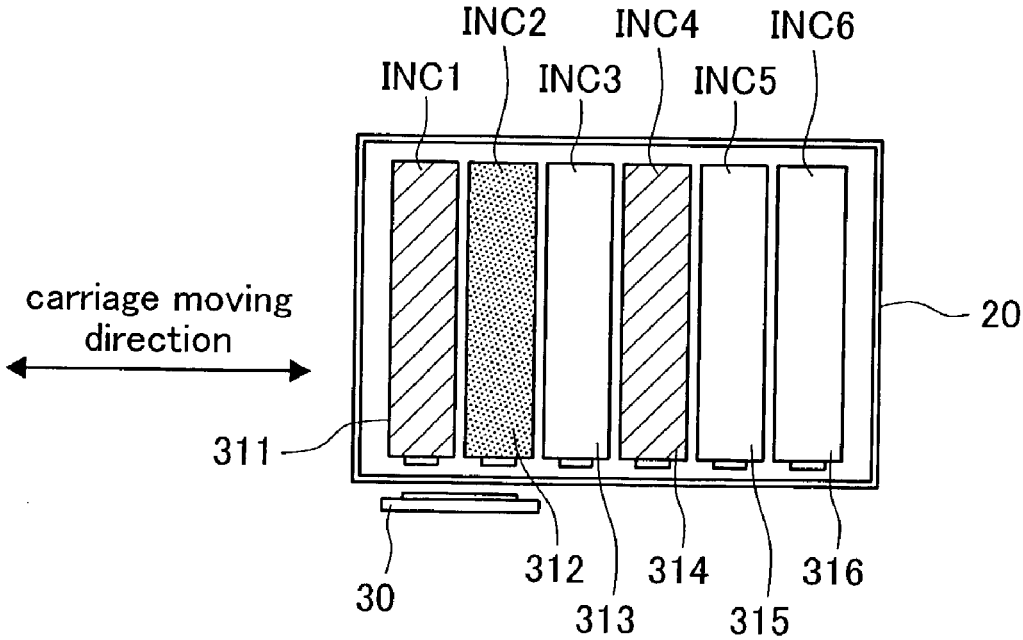

FIGS. 3(*a*) and 3(*b*) are schematic diagrams illustrating, in simplified form, the positional relationship of the carriage 20 and ink units INC1 through INC6, memory elements 311 through 316 provided for the ink units, and the transmitter/receiver 30 provided on the printer 10 main unit (part of printer 10 excluding the ink units INC1 through INC6) serving as the printer main unit. FIG. 3(*a*) is an oblique view of the device seen from the front in FIG. 2, and FIG. 3(*b*) is a plan view seen from directly above.

The ink units INC1 through INC6 housed in the carriage 20 are individually detachable, and can be replaced as needed by the user when the ink is consumed, when the expiration date has passed, or when it is desired to changed to another color, etc.

FIG. 3(*b*) shows that the transmitter/receiver 30 (more precisely, the antenna of the transmitter/receiver 30) in the present embodiment has a size corresponding to about two sections of the ink units (and the memory elements thereabove) on the surface where the memory elements 311 to 316 are disposed. As an alternative, the transmitter/receiver 30 may have a size corresponding to one section on the surface where the memory element is disposed, or even a size corresponding approximately to three or more sections.

The transmitter/receiver 30 carries out reading of the ID information in sequence from left to right, that is, from the first memory element 311 to the sixth memory element 316, and performs memory access operations including a data reading operation for data other than ID information, and a data writing operation for data such as data on the amount of ink remaining. Details on the ID information reading operation and memory access operation are described below.

C. Structure of Memory Element and Transmitter/receiver

Figure 4A:
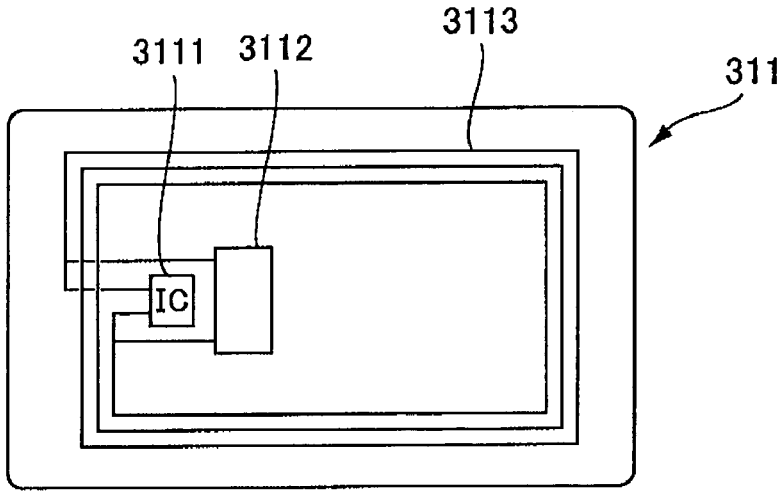
FIG. 4(*a*) and 4(*b*) illustrate the structure of a memory element, and the internal structure of the memory element and a read sensor.
Figure 4B:
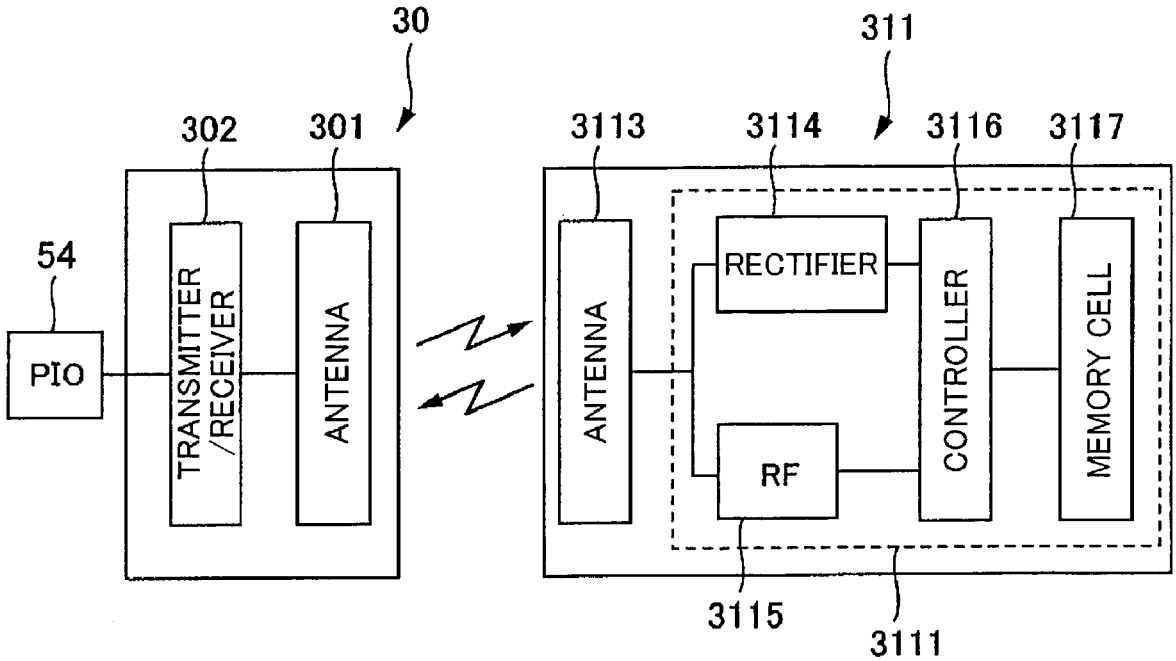

The structure of the memory element 311 and transmitter/receiver 30 are described below with reference to FIGS. 4(*a*) and 4(*b*). FIG. 4(*a*) is plan view illustrating an example of the structure of the memory element 311. The memory element 311 is a proximity type of non-contact memory element capable of transmitting data to and receiving data from the transmitter/receiver 30 within a distance of about 10 mm. Overall, it is extremely small and thin, and can be attached to a target object by making one side adhesive as a seal. The other memory elements have the same structure as the memory element 311 and therefore will not be described.

The memory element 311 has an IC chip 3111, a resonance capacitor 3112 formed by etching a metal film, and a flat coil 3113, which are mounted on a plastic film (not shown) and covered with a transparent cover sheet (not shown). Although not shown in FIG. 4(*a*), the transmitter/receiver 30 is composed of a communication circuit 302 (FIG. 4(*b*)) and a coil antenna 301 which is similar to the antenna of the memory element 311, with power being supplied from the power source unit of the printer main unit 10 (FIG. 1).

Power is supplied only when the transmitter/receiver 30 and the memory elements 311 through 316 are proximate to each other. Accordingly, no communication operation is carried out during ordinary printing operations, when no electrical power is supplied to the memory elements 311 through 316.

FIG. 4(*b*) is a block diagram illustrating the internal structure of the memory element 311 and transmitter/receiver 30. The transmitter/receiver 30 is composed of an antenna coil 301, and a communication circuit 302 connected to a peripheral input/output component (PIO) 54 in the printer main unit control circuit described below. The IC chip 3111 of the memory element 311 is composed of a rectifier 3114, RF (radio frequency) signal analyzer 3115, controller 3116, and memory cell 3117. The memory cell 3117 is an electrically readable/writable memory such as a NAND flash ROM. The controller 3116 can be in the form of a logic circuit performing control functions, or can be in the form of a microprocessor performing control functions by running a suitable program. As used herein, circuits with an antenna, memory, and controller for controlling non-contact communication-based memory access, as in the example of the memory element 311, are each referred to simply as a "memory circuit."

The antenna 3113 of the memory element 311 and the antenna 301 of the transmitter/receiver 30 communicate with each other to read ID information in the memory cell 3117 or to carry out memory access. The high frequency radio signals produced in the communication circuit 302 of the transmitter/receiver 30 are induced in the form of a high frequency electromagnetic field through the antenna 301. The high frequency electromagnetic field is received through the antenna 3113 of the memory element 311 and is rectified by the rectifier 3114, resulting in DC current driving each circuit in the IC chip 3111.

Data, that is, ID information unique to each memory element, such as the serial number of the element, are stored in advance in the memory cell 3117 of the memory element 311. The ID information should undergo a writing process during the processing and manufacturing of the memory element. Thereafter, the ID information can be read by the transmitter/receiver 30 of the printer main unit, thereby allowing each memory element 311 through 316 to be distinguished.

The memory cell 3117 of the memory element 311 may contain manufacturing data for the ink unit INC1 to which the memory element 311 is adhered, and such data preferably relates to the expiration period, or the like. The data can be read by the printer main unit and compared to the current date so as to notify the user that the expiration date of the ink unit INC1 is approaching.

Data relating to the amount of ink remaining in the ink unit INC1 and the like can be written to the memory cell 3117 in the present embodiment. The data on the remaining amount can be read by the printer main unit, and a report can be issued to the user when the amount is running out. The memory elements 311 through 316 may also contain suitable data other than that discussed above.

Figure 5A:
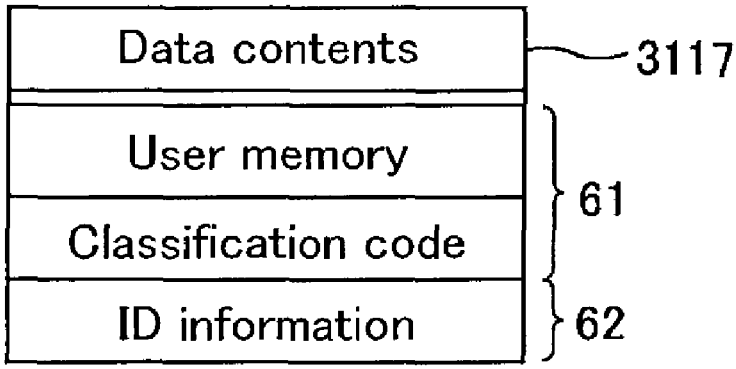
FIG. 5(*a*) and 5(*b*) are block diagrams that show the contents of a memory element and the manufacturing data among the contents.
Figure 5B:
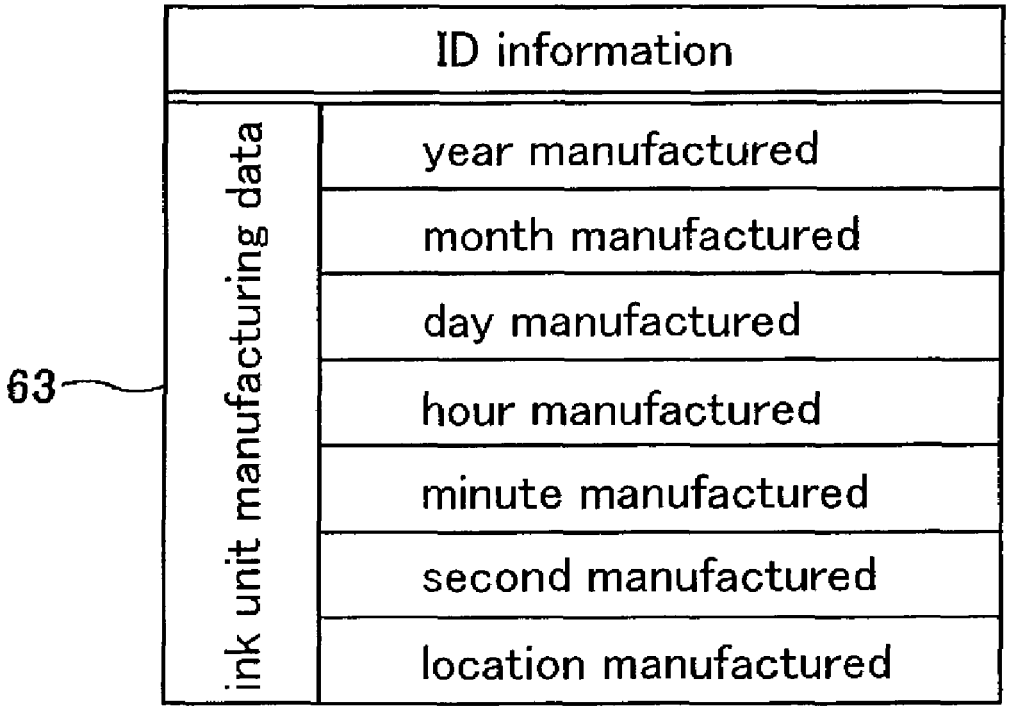

FIG. 5(*a*) is a table illustrating the details of the data stored in the memory cell of the memory element. As indicated in FIG. 5(*a*), the memory cell 3117 has a writable area 61 where data can be read and written by the printer main unit, and a non-writable area 62 where data can be read, but not written, by the printer main unit.

The data written in the non-writable area 62 is written before the memory element 311 is attached to the ink unit INC1, such as during the process in which the memory element 311 is fabricated or the process in which the ink unit INC1 is manufactured. The printer main unit thus can read and write data stored in the writable area 61, but can only read, and not write, data in the non-writable area 62.

The writable area 61 is divided into a user memory area and a classification code memory area. Of these, the user memory area is used to record data such as the amount of ink remaining in the ink unit INC1. The data on the remaining ink amount can be read by the printer main unit to issue a report to the user when the ink is running out. A variety of codes for distinguishing the ink unit type or the like also can be stored in the classification code memory area, and the user can freely use these codes.

The non-writable area 62 serves as the area for storing the ID information. Unique ID information for distinguishing the memory element 311, including manufacturing data related to the ink unit to which the memory element 311 is attached, is stored in the area for storing the ID information.

FIG. 5(*b*) is a table showing in greater detail an arrangement for the contents of the area for storing the ID information. The area for storing the ID information has an ink unit manufacturing data area 63 for storing various types of manufacturing data related to the ink unit to which the memory element 311 is attached.

Data representing the year, month, date, time, minute, second, and location where the ink unit was produced can be stored in the ink unit manufacturing data area 63. Each piece of data can be written to an area of about 4 to 8 bits, which will require a total memory area of about 40 to 70 bits. The manufacturing data 63 relating to the ink unit can be stored in the non-writable area 62 and not in the user memory of the writable area 61, so as to allow that much more data to be written to the writable area 61 of the memory cell 3117.

When the ID information including manufacturing data on the ink units INC1 through INC6 is read from the memory elements 311 through 316 at a timing when the printer 10 is powered on or the like, the user may be notified that the ink unit expiration date is approaching, for example.

The memory cell 3117 of the memory elements 311 through 316 may also include other suitable data in addition or in place of that described above. The memory cell 3117 in its entirety may constitute the writable area, in which case, the entire memory cell 3117 may be composed of an electrically readable/writable memory such as NAND type flash ROM for storing memory element-specific ID information such as the above ink unit manufacturing data.

D. Internal Structure of Ink Jet Printer

Figure 6:
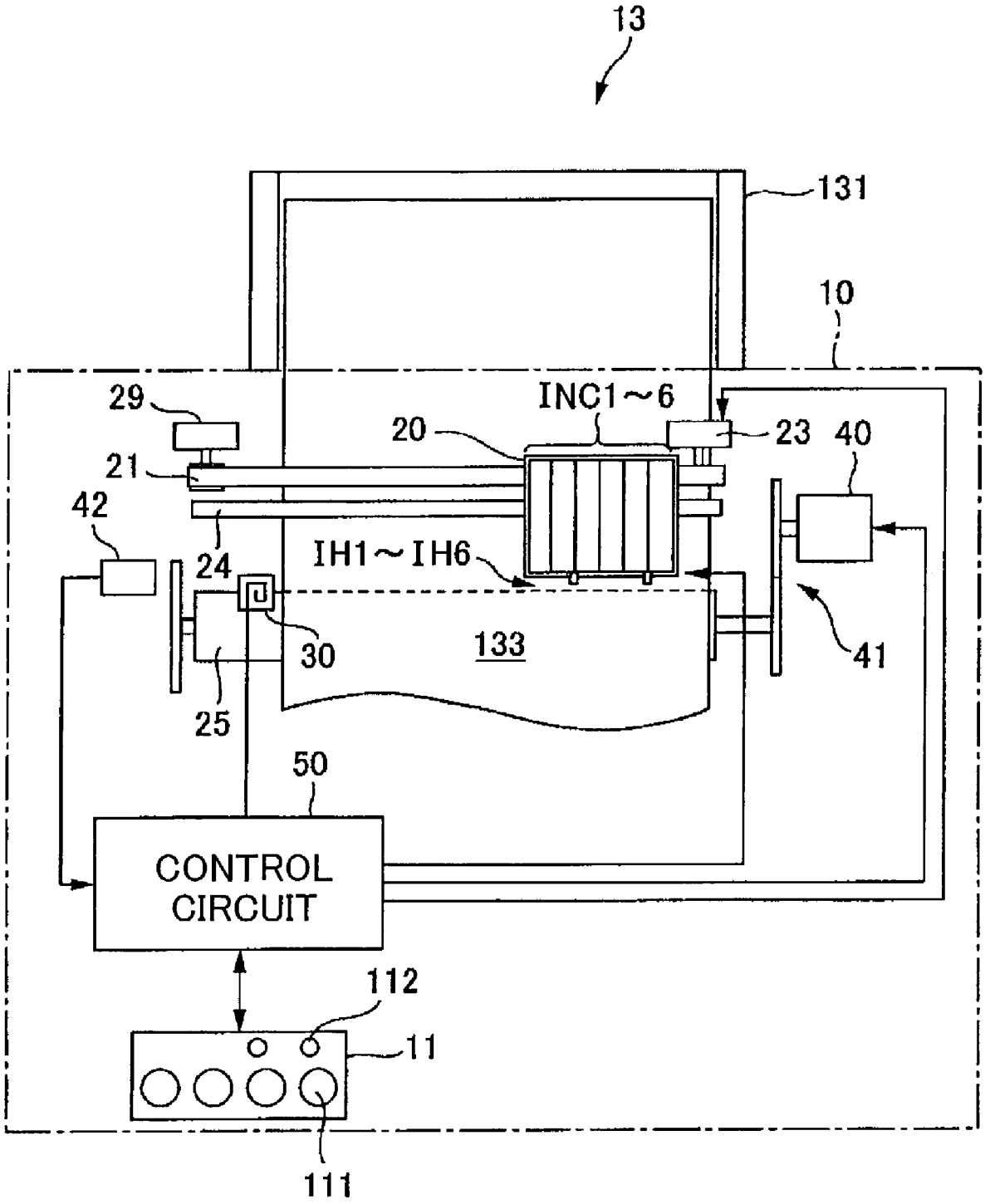
FIG. 6 illustrates the internal structure of the ink jet printer.

The internal structure of the color ink jet printer 10 is discussed below with reference to FIG. 6. FIG. 6 illustrates the internal structure of the printer 10 in the present embodiment.

As depicted, the printer 10 includes a mechanism for driving the print heads IH1 through IH6 mounted on the carriage 20 to eject ink and form dots, a mechanism for moving the carriage 20 back and forth in the axial direction of the platen 25 by means of a carriage motor 23, a mechanism by which a printing object such as cut paper 133 fed from the paper feed tray 131 is conveyed by means of a motor 40, and a control circuit 50.

The mechanism for moving the carriage 20 back and forth in the axial direction of the platen 25 is composed of a guide shaft 24 that is arranged parallel to the axis of the platen 25 to slidably support the carriage 20, and a pulley 29 with an endless drive belt 21 stretched between it and the carriage motor 23.

The mechanism for conveying the printing object includes the platen 25, a paper feed motor 40 for rotating the paper feed auxiliary roller (not shown in figure) and platen 25, gear mechanism 41 for transmitting the rotation of the paper feed motor 40 to the platen 25 or the like, and an encoder 42 for detecting the angle of rotation of the platen 25. The transmitter/receiver 30 is located at a suitable position on the inside surface of the printer 10 casing (not shown in figure), such as specific locations in the non-printing area on the left side of the carriage 20.

The control circuit 50 controls the operation of the paper feed motor 40, carriage motor 23, and print heads IH1 through IH6 while receiving signals from the printer control panel 11, transmitter/receiver 30, externally connected personal computer, or the like. Cut paper fed from the paper feed tray 131 is set up between the platen 25 and paper feed auxiliary roller, and conveyed in the prescribed amount at a time according to the angle of rotation of the platen 25.

Ink units INC1 through INC6 are installed on the carriage 20. Ink cartridges INC1 through 6 are equipped with memory elements 311 through 316 for storing the amount of ink remaining, or the like. By way of non-limiting example, ink cartridge INC1 contains black (K) ink, and ink cartridges INC2 through 6 are filled with cyan (C), magenta (M), yellow (Y), light cyan (LC), and light magenta (LM), respectively. It will be appreciated that the same colors can be provided in different orders, and that other colors, or even a single color, could be used.

E. Internal Structure of Control Circuit

Figure 7:
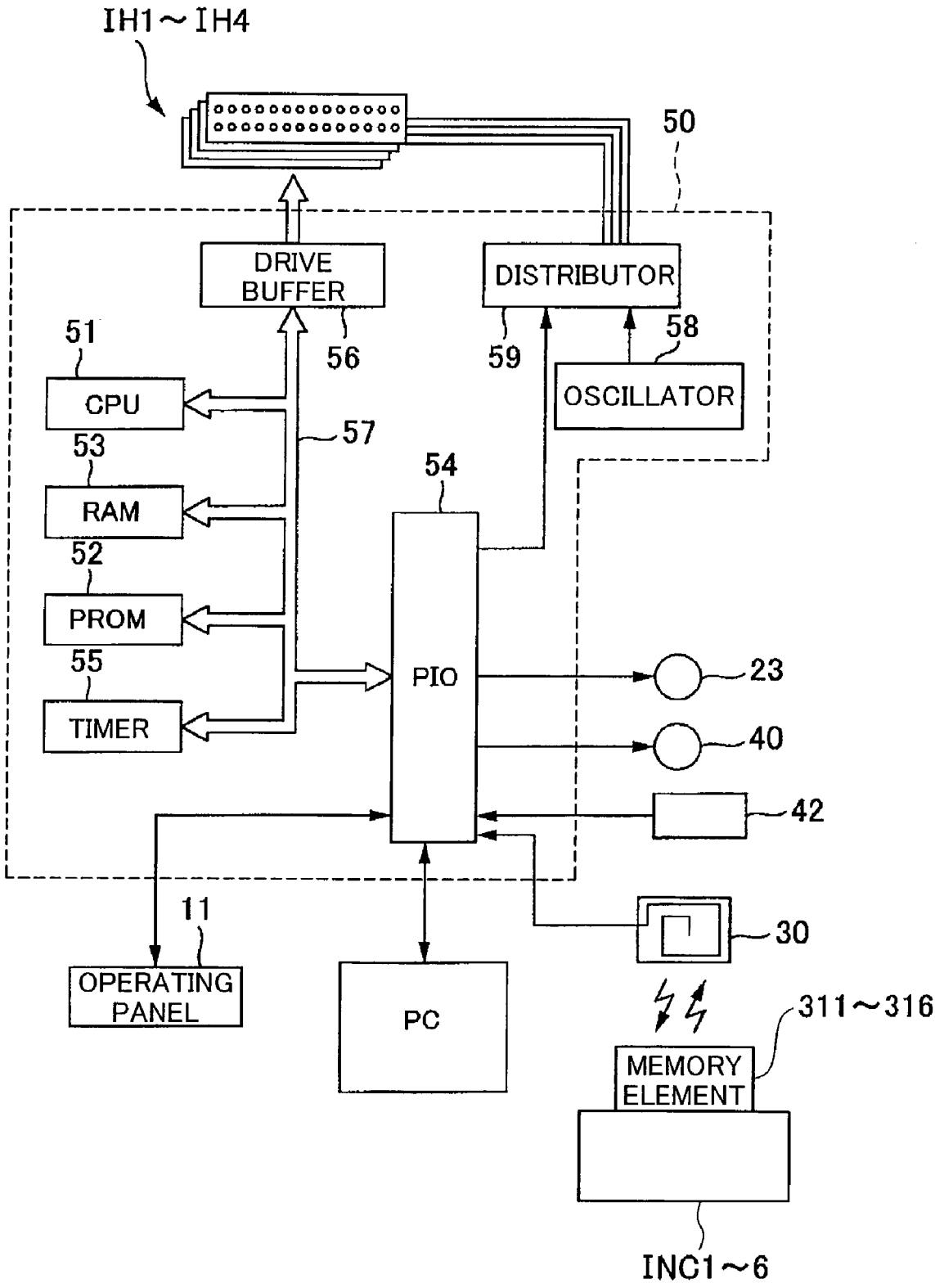
FIG. 7 is a block diagram showing the internal structure of the control circuit in the ink jet printer.

The internal structure of the ink jet printer control circuit 50 is discussed below with reference to FIG. 7. FIG. 7 is a block diagram of the internal structure of the ink jet printer control circuit 50 in the present embodiment.

As illustrated in the Figure, a CPU 51, PROM 52, RAM 53, peripheral input/output (PIO) 54, timer 55, drive buffer 56, and the like are provided inside the control circuit 50.

The operating panel 11, personal computer PC, carriage motor 23, paper feed motor 40, encoder 42, and transmitter/receiver 30 are connected to the PIO 54. The drive buffer 56 is used as a buffer to supply on/off signals for forming dots to the print heads IH1 through IH6. These components are connected to each other by a bus 57, allowing them to exchange data with each other. The control circuit 50 is also provided with an oscillator 58 that outputs a drive waveform at a particular frequency, and a distributor 59 that distributes the output from the oscillator 58 at a specific timing to the print heads IH1 through IH6.

When the power is on or the like, the control circuit 50 allows the carriage 20 to move to the non-printing area on the left side of the transmitter/receiver 30, and reads sequentially, first from the memory element 311 disposed on the ink unit INC1 at the left end up to the memory element 316 on the right end. The control circuit 50 thus obtains ID information from the memory elements 311 through 316. Once the ID information has been obtained from all the memory elements 311 through 316, memory access is processed as the memory elements 311 through 316 (and ink units INC1 through INC6) are distinguished on the basis of the ID information. Details on the ID information reading process (first procedure) and the memory access process carried out as the elements are distinguished on the basis of the ID information (second procedure) are given below.

F. Operation of Ink Jet Printer

Figure 8:
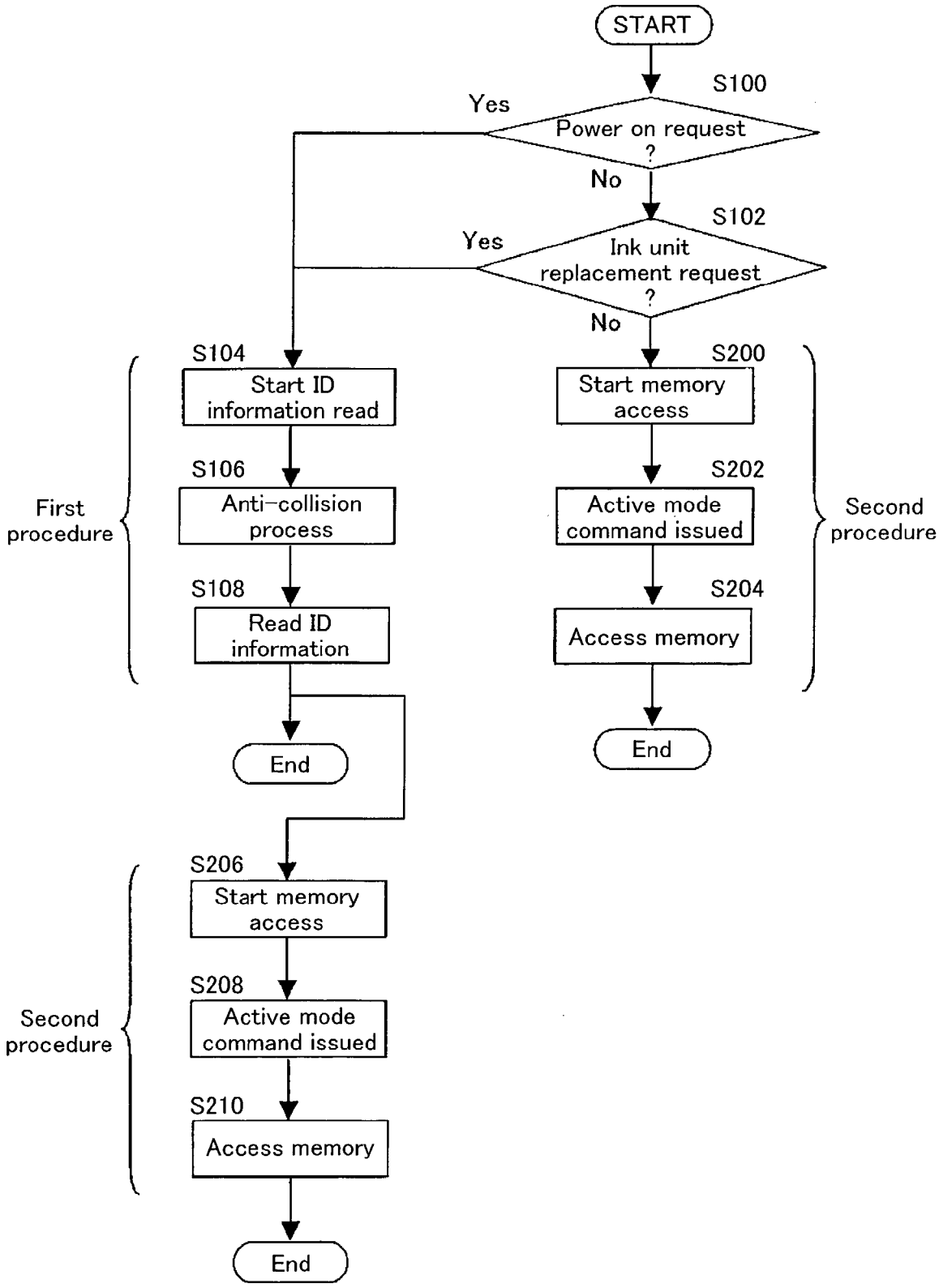
FIG. 8 is a flow chart showing the flow of communication between the printer main unit and memory element, and, more specifically, the steps involved in the ID information reading process (first procedure) and the memory access process (second procedure) such as the process for reading data other than the ID information or the process for writing data on the remaining amount of ink.
Figure 9A:
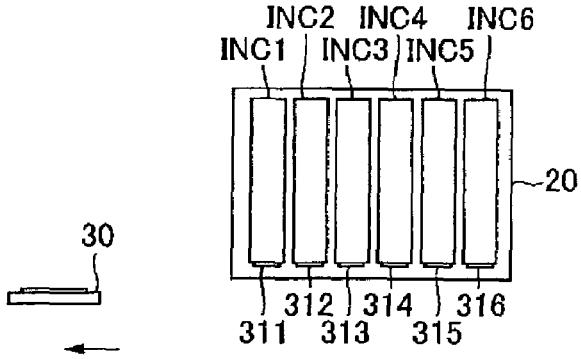
FIGS. 9(*a*)-9(*e*) illustrate the movement of the carriage when reading ID information, and, more specifically, the carriage operating sequence when the transmitter/receiver reads the ID information of the memory element.
Figure 9B:
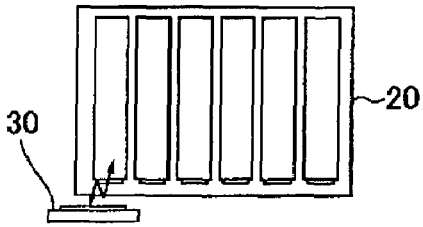
Figure 9C:
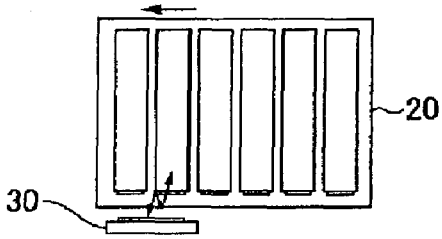
Figure 9D:
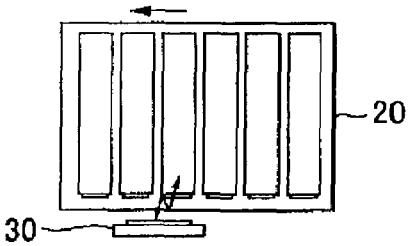
Figure 9E:
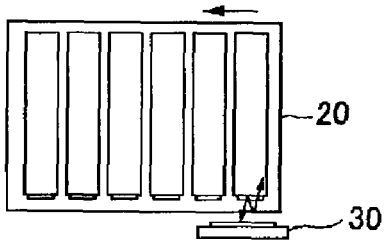
Figure 10A:
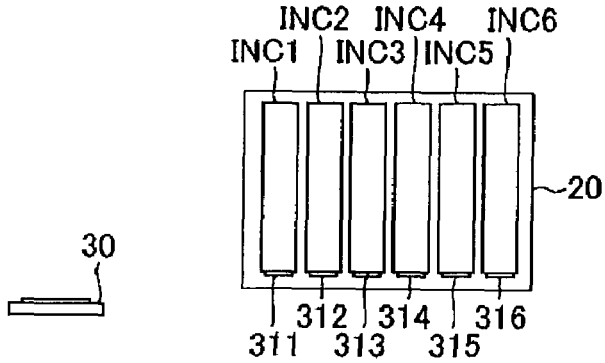
FIGS. 10(*a*)-10(*d*) illustrate the movement of the carriage when reading non-ID information, and, more specifically, the carriage operating sequence when the transmitter/receiver reads data other than the ID information in the memory element.
Figure 10B:
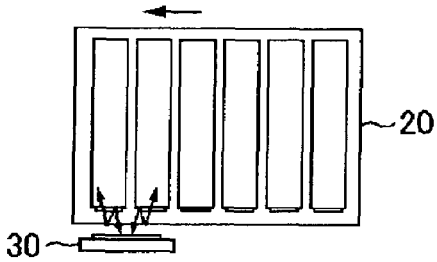
Figure 10C:
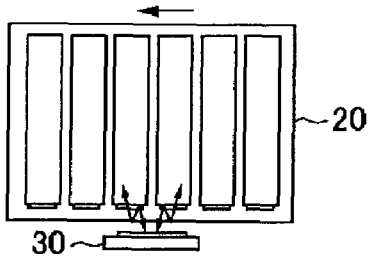
Figure 10D:
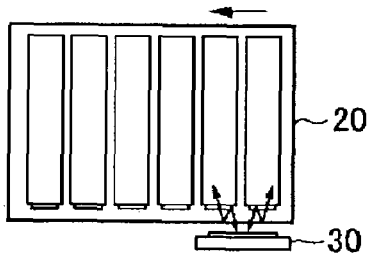

FIG. 8 is a flow chart depicting the steps involved in the communication process between the memory elements 311 through 316 in the ink units INC1 through INC6 and the transmitter/receiver 30 in the printer 10 main unit, that is, the ID information reading process (first procedure) and the memory access process (second procedure) including the process of reading data other than the ID information and the process of writing data related to the ink units such as data on the amount of ink remaining.

The printer 10 runs a communication process routine with memory elements 311 through 316 which is different from the communication process that is run during the ordinary printing process, so as to read the manufacturing data of the ink units or run a process such as the read/write process of the remaining ink whenever (1) the power is turned on, (2) the user replaces any of the ink units INC1 through INC6 while the power is on, or (3) a predetermined time has elapsed since the prior communications process has been run, and so forth.

At such times, the carriage 20 housing the ink units INC1 through INC6 first moves from the ordinary printing position or the non-printing area on the right side to the printing area on the left side. The carriage 20 moves to the non-printing area on the left side to permit communication by the memory element 311 or the like near the transmitter/receiver 30 upon the reception of signals from the antenna coil 301 of the transmitter/receiver 30.

In the communication routine thus started in this manner between the transmitter/receiver 30 and the memory elements 311 through 316, the control circuit 50 in the printer main unit 10 determines whether or not there has been a request to turn on the power (step S100). Specifically, it is determined whether or not the operation of the ink jet printer 10 has started. The request for power on is a signal that is produced to request communication with the ink units when the user presses the power button on the printer 10 to supply power, and is also referred to as the "power on notification." When it is determined that a power on request has been issued (step S100: Yes), the first procedure, that is, the procedure for reading the ID information from the memory elements 311 through 316, is initiated (step S104).

When it is determined that no power on request has been issued (step S100: No), the control circuit 50 determines that the printer 10 is in the midst of the ordinary printing process, and it is then determined whether or not an ink unit replacement request has been issued (step S102). The ink unit replacement request is a signal, for example, that is produced to request communication with the ink units after the user has pressed the ink unit replacement button 111 on the operating panel while the power is on to replace any of the ink units INC1 through INC6, also referred to as the "ink unit replacement notification."

When it is determined that an ink unit replacement request has been issued (step S102: Yes), the control circuit 50 initiates the first procedure, that is, the procedure for reading the ID information from the memory element in the replaced ink unit (step S1104). When it is determined that no ink unit replacement request has been issued (step S102: No), it is determined that the ID information of the memory elements 311 through 316 have already been properly read such as when the power is already on, and the second procedure, that is, the memory access process with the memory elements 311 through 316, can be immediately started (step S200).

When the second procedure is started, the control circuit 50 first issues an active mode command to the memory elements 311 through 316 (step S202). The active mode command is a command issued to the memory elements 311 through 316 according to the ID information of each. When the received ID information is cross-checked and found to be consistent with the ID information of the memory elements 311 through 316, a memory access OK signal is transmitted to the transmitter/receiver 30.

When the control circuit 50 obtains an OK response to the active mode command from all the memory elements 311 through 316, the memory access process for the memory elements 311 through 316 is executed (step S204). In this way, when the ID information has already been properly read other than when the power is turned on or the like, the second procedure starts without the first procedure being run, allowing the time needed for the communication process to be shortened. The ID information reading process (first procedures) should be run again when no access OK response is obtained from any of the memory elements.

The control circuit 50 concludes this communication process routine when the memory access process is concluded, and the data on the amount of ink remaining is finished being written to the memory elements 311 through 316.

When the control circuit 50 starts the first procedure, that is, the procedure for reading the ID information from the memory elements 311 through 316 (step S104), the anti-collision process is then run (step S106). The anti-collision process is a process for preventing mixed signals during the process of reading the ID information from the memory elements 311 through 316 when no ID information has been obtained from the elements. Also, if the anti-collision process breaks down while being run, the anti-collision process should be run again after being restarted. The details of the anti-collision process are given below.

Upon the conclusion of the anti-collision process, the control circuit 50 runs the process for reading the ID information from memory elements 311 through 316 (step S108). When the process for reading the ID information concludes, the present communication process routine will be complete, and the memory access process with the memory elements 311 through 316 will start (step S206).

When the control circuit starts the memory access process, the subsequent processes (steps S208 and S210) are the same as the aforementioned steps S202 and S204, and will therefore not be described again here. The present communication process routine is complete when the memory access process is completed and the data on the amount of ink remaining is finished being written to the memory elements 311 through 316.

The first procedure (communication process) and second procedure (memory access process) involving the memory elements 311 through 316 in ink units INC1 through INC6 and the transmitter/receiver were described above, but as described below, the communication process with the memory elements 312 through 316 is executed sequentially one at a time from the memory element 311 on the left end to the memory element 316 on the right end. At such times, the carriage 20 moves sequentially and stops one ink unit at a time to run the communication process for the memory element of each ink unit. Alternatively, the movement and positioning of the carriage 20 is preferably reduced using an antenna having a size corresponding to about two ink unit sections, such as the transmitter/receiver 30 in the present embodiment, so the carriage can move and stop a total of three times (every two ink units) to run the communication process on two memory elements at a time at each location.

The operation of accessing the memory elements 311 through 316 mounted in the ink jet printer 10 is discussed below with reference to FIGS. 9 and 10.

FIGS. 9(*a*)-9(*c*) illustrate the operating sequence of the carriage 20 (and ink units INC1 through INC6) when the transmitter/receiver 30 reads the ID information in the memory elements 311 through 316 while the power is turned on or during the replacement of an ink unit. Commands to run the ID information reading operations other than in these cases can be carried out when the user runs printer driver software on the screen of a personal computer connected to the printer 10 or by using the operating panel 11 (FIG. 1) of the printer 10.

The transmitter/receiver 30 (more exactly, the antenna) in the present embodiment is preferably of a size corresponding to about two sections of the ink units (and the memory elements thereabove) on the surface where the memory elements are disposed. When the transmitter/receiver 30 stops the carriage 20 exactly between a given memory element and an adjacent memory element, then because of the range over which signals can be sent by that antenna, data can be transmitted to the two memory elements. The transmitter/receiver 30 reads or writes the ID information sequentially from the left end in the figure, that is, from the first memory element 311, to the sixth memory element on the right end.

First, in an unaccessed state (step S110 of FIG. 9(*a*)) where the transmitter/receiver 30 has not accessed any of the memory elements 311 through 316, the carriage 20 is positioned to the right at some distance from the non-printing area on the left side where transmitter/receiver 30 is located, preventing any of the memory elements 311 through 316 of ink units INC1 through 6 from being accessed.

Next, while the ink unit INC1 is accessed (step S111 in FIG. 9(*b*)), the carriage 20 moves up to the non-printing area on the left side and stops at a location permitting data communication between the transmitter/receiver 30 and only the ink unit INC1 on the left end. That is, the right end of the antenna coil 301 of the transmitter/receiver 30 is in a position corresponding to about the middle of the memory element 311, and in that position the transmitter/receiver 30 is too far from the memory element 312 of the ink unit INC2 to be able to transmit data. In this embodiment, non-contact communication between the transmitter/receiver 30 and the memory element is possible only at a distance within about 10 mm, so the gap between the transmitter/receiver 30 and the second memory element 312 at the stop position in FIG. 9(*b*) is sufficiently greater than 10 mm to prevent such communication. At this stop position, the transmitter/receiver 30 first reads the ID information in the memory element 311. In other words, the transmitter/receiver 30 reads the ID information at a position where it is possible to distinguish the position of the first ink unit targeted for the ID check process. The operating mode of the memory element during the process for reading the ID information is referred to as "anti-collision mode."

Because the ID information here includes manufacturing data related to the ink unit INC1, when it is determined, for example, by the printer 10 main unit that, based on the date of manufacture, the expiration date of the ink unit INC1 is approaching, a report to the user can be displayed on the screen of the personal computer PC or a display provided on the printer 10 main unit.

The carriage 20 then stops at a location corresponding to one ink unit to the right, and reads the ID information of the memory element 312 of the second ink unit INC2 (S112 in FIG. 9(*c*)). At this stop position, the transmitter/receiver 30 can still access the memory element 311, so in order to prevent mixed data signals, the ID information of the memory element 311 which has already been read are included in the ID information read command (referred to as "anti-collision command") transmitted from the transmitter/receiver 30 to the memory element 312. The ID information of the memory element 311 is used to distinguish the memory elements 311 and 312, allowing the ID information to be accurately read from the memory element 312. Alternatively, the memory element 311 may be automatically removed from anti-collision mode when the process of reading its ID information is complete, so that the memory element 311 does not receive subsequent anti-collision commands.

The ID information of memory elements 313 through 316 of ink units INC3 through INC6 is subsequently read in sequence in the same manner (S113 through S116 in FIGS. 9(*d*) to (*d*)). After the ID information of the final memory element 316 has been read (S116), the carriage 20 is returned to the position in the non-printing area on the right side, and the ID information read routine is complete. Because all the ID information of memory elements 311 through 316 has thus been obtained, the printer 10 main unit can ascertain the arrangement of the ink units INC1 through INC6. That is, the memory of the printer main unit stores the sequence in which all of the ink units INC1 through INC6 are arranged in the carriage 20, for example, where the ink unit INC1 corresponding to the ID information obtained from the memory element 311 is disposed on the leftmost side, and the ink unit INC2 corresponding to the ID information obtained from the memory element 312 disposed in the adjacent position to the right. In other words, in the aforementioned procedures, the ID information of each ink unit is checked while the position of an ink unit targeted for the ID check can be distinguished, so that the position of each ink unit and its ID information is stored in memory in the printer main unit.

The following is a description of the operation by which the transmitter/receiver 30 reads data other than ID information stored in the memory elements 311 through 316 by using data concerning the relation between the arrangement sequence of the ink units INC1 through INC6 and the ID information ascertained in the above steps. FIGS. 10(*a*)-10(*d*) illustrate the operating sequence of the carriage 20 (and ink units INC1 through INC6) when the transmitter/receiver 30 reads data other than ID information stored in the memory elements 311 through 316.

First, in an unaccessed state (step S220 of FIG. 10(*a*)) where the transmitter/receiver 30 has not accessed any of the memory elements 311 through 316, the carriage 20 is positioned to the right at some distance from the non-printing area on the left side where the transmitter/receiver 30 is located, preventing any of the memory elements 311 through 316 of ink units INC1 through 6 from being accessed.

Next, while the ink units INC1 and INC2 are accessed (step S221 in FIG. 10(*b*)), the carriage 20 moves up to the non-printing area on the left side and stops at a location where the transmitter/receiver 30 can transmit data to the ink unit INC1 on the left end and the adjacent ink unit INC2. That is, the middle of the antenna coil 301 of the transmitter/receiver 30 is in a position corresponding to the area between the memory element 311 and the memory element 312, and in that position the transmitter/receiver 30 is capable of transmitting data to both memory elements 311 and 312 of ink units INC1 and INC2.

The transmitter/receiver 30 transmits data read commands to the memory elements 311 and 312 at the stop position. At that time, the ID information of the memory element 311 which has already been read is allowed to accompany the first memory element 311. The memory element 311 receiving this command checks that the accompanying ID information is actually the ID information of the memory element 311 itself, and transmits the requested data other than the ID information back to the transmitter/receiver. The same reading process is similarly carried out for the second memory element 312.

The carriage 20 then stops at a location corresponding to two ink units to the right, and reads the ID information of the memory elements 313 and 314 of the second ink units INC3 and INC4 (S222 in FIG. 10(*c*)). At this stop position, data other than the ID information are read while the memory elements 313 and 314 are accurately distinguished in the same manner as the reading process for memory elements 311 and 312 above.

The carriage 20 is similarly moved and stopped two ink unit sections to the right (S223 in FIG. 10(*d*)), and the non-ID information of memory elements 315 and 316 is read. The routine is then complete.

The carriage 20 is moved and positioned a total of three times by reading the non-ID information while stopping the carriage 20 at positions where the transmitter/receiver 30 can access two memory elements at a time, as in the present embodiment. Although memory elements can be read one at a time while moving and positioning memory elements one at a time, this embodiment is more desirable because it can be completed with half the moving and positioning operations, thus shortening the time needed for the reading process as a whole. In general, when the transmitter/receiver 30 can communicate with N ink units at the same position, the transmitter/receiver 30 should be moved N ink unit sections at a time.

Ink unit-related data such as data on the amount of ink remaining in ink units INC1 through INC6 can be written at any time through the transmitter/receiver 30 to the writable area in the memory cell 3117 of the memory elements 311 through 316. The writing operation in such cases can be managed while the memory elements are accurately distinguished using the ID information of the memory elements 311 through 316 which has already been read, in the same manner as the process for reading the non-ID information above.

G. Details of Anti-collision Process

Figure 11:
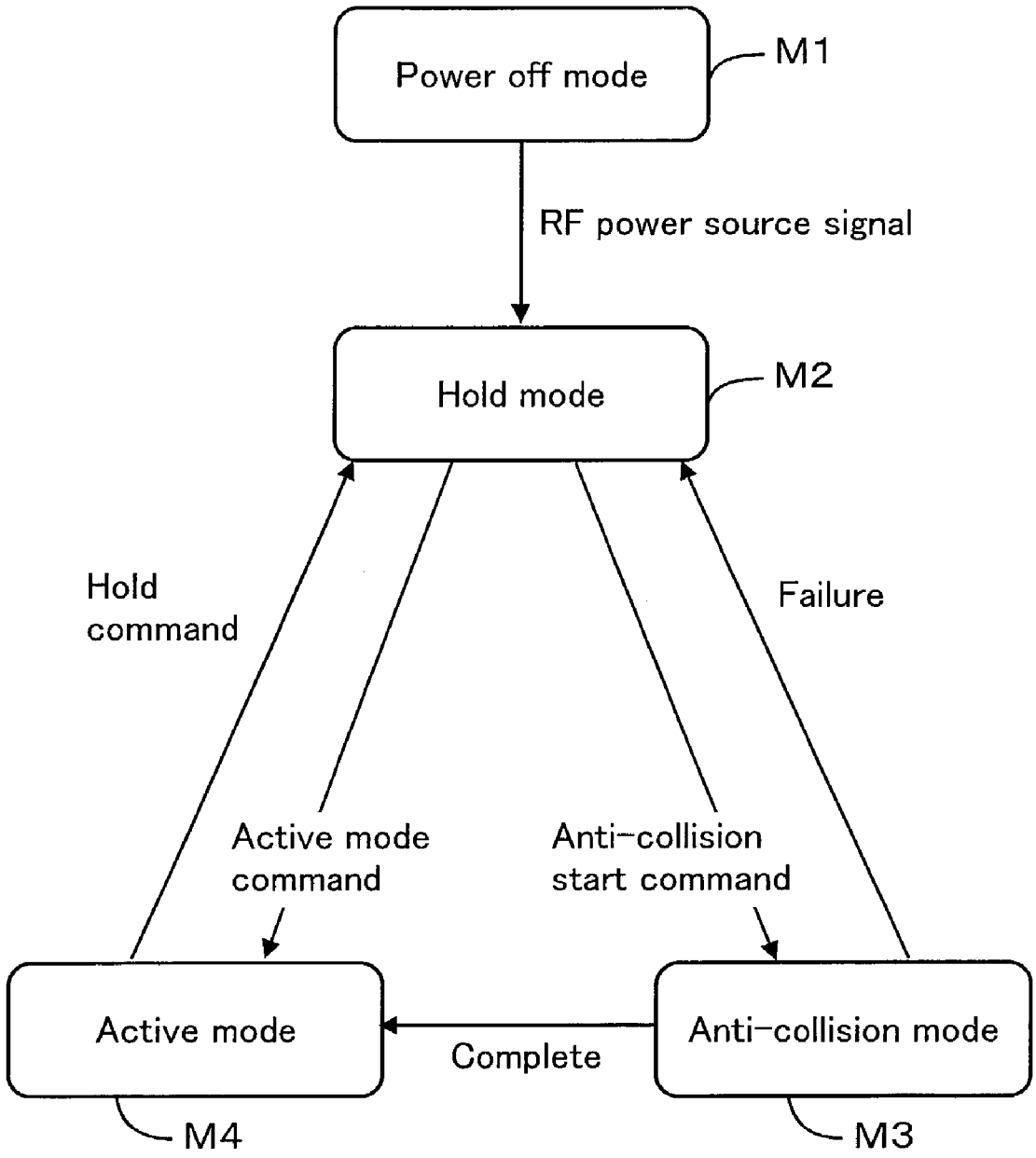
FIG. 11 illustrates the transition in operating modes of the memory element 311.

FIG. 11 illustrates the transition in operating modes of the memory element 311. The memory element 311 has four modes: a power off mode M1, hold mode M2, anti-collision mode M3, and active mode M4. Power off mode M1 is a state in which no high frequency signals are received from the transmitter/receiver 30, and no power output is produced in the memory element 311. When the transmitter/receiver 30 and the memory element 311 move to within about 30 mm of each other to allow the memory element 311 to receive high frequency signals, the memory element 311 shifts from power off mode M1 to hold mode M2. Hold mode M2 may be also referred to as a standby mode. The distance at which communication becomes possible is preferably about 15 mm, and even more preferably about 10 mm.

When the memory element 311 receives an anti-collision start command from the transmitter/receiver in hold mode M2, it moves to anti-collision mode M3. Anti-collision mode M3 is a mode for the anti-collision process described above (ID information check). In the example illustrated in FIG. 11, when the anti-collision process is complete (that is, when the ID information has been successfully checked), the memory element 311 automatically shifts to active mode M4. Should the ID check breaks down during the anti-collision process, the memory element 311 returns from anti-collision mode M3 to hold mode M2. The details of the anti-collision process will be described later. When the memory element 311 is in anti-collision mode M3, the transmitter/receiver 30 can only check ID information of the memory element 311 through the anti-collision process but cannot perform other memory access operations on the memory element 311. The anti-collision process can be performed only when the memory element 311 is in anti-collision mode M3.

Active mode M4 is a mode for accessing memory. When the memory element 311 is in active mode M4, the transmitter/receiver 30 can read from and write to the memory cell 3117 (FIG. 4). When the memory element 311 is in a mode other than active mode M4, the transmitter/receiver 30 cannot perform memory access operations on the memory element 311. The memory element 311 shifts to active mode M4 upon receiving an active mode command in hold mode M2. As noted above, when the ID information has been successfully checked, the element automatically shifts from anti-collision mode M3 to active mode M4. The memory element 311 returns to hold mode upon receiving a hold command in active mold M4.

The anti-collision start command includes a specific portion of the ID information shared by a plurality of cartridges, allowing a plurality of cartridges to simultaneously move to anti-collision mode M3. The anti-collision start command does not need to include ID information, however. The active mode command includes all cartridge ID information, allowing only one cartridge memory element 311 to shift to active mode M4. The hold command also includes all cartridge ID information. Including part or all of the ID information in the commands which the memory element 311 can receive, as in this example, is more desirable in that it permits more reliable access to the memory element 311.

In this way, when the memory element 311 in the present embodiment receives an active mode command while in hold mode M2, it can move directly from hold mode M2 to active mode M4 without undergoing an anti-collision process. A resulting advantage is that the transmitter/receiver 30 can issue an active mode command for an ink unit in which the ID information has been previously checked, so as to immediately start the memory access process. Such an advantage is not limited to the ink jet printer 10 as in the present embodiment. It will be understood that this invention is particularly suited for use in devices in which cartridges are generally not replaced very frequently, such as, but not limited to, ink jet recording devices and electrostatic printers. That is, in this sort of device, once the ID of the cartridges has been checked by the anti-collision process, the cartridge ID is already known, and the anti-collision process therefore does not have to be carried out again. The active mode command can thus be used to avoid having to carry out the anti-collision process every time memory is accessed, resulting in the significant advantage of more rapid memory access.

Figure 12:
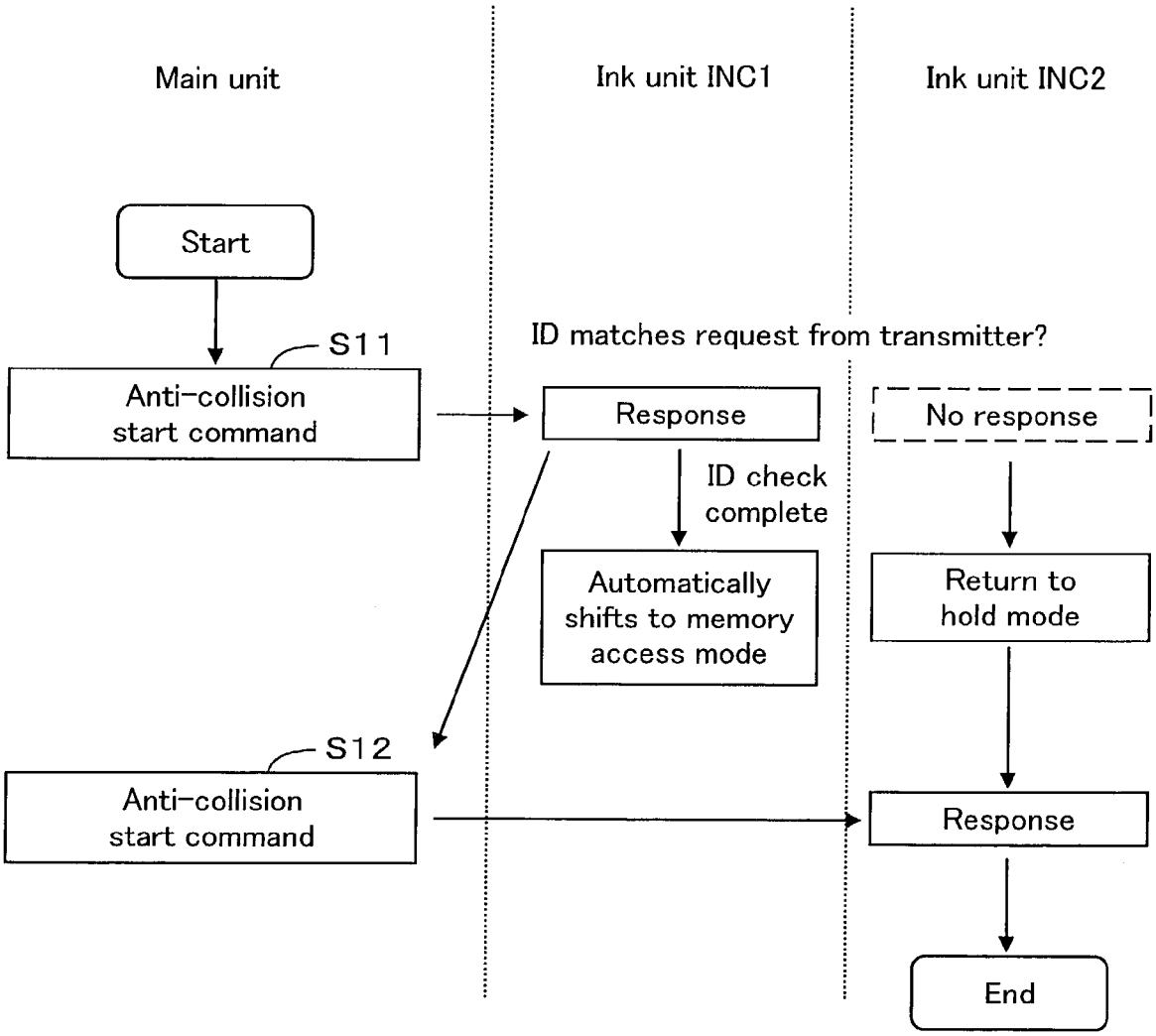
FIG. 12 is a flow chart detailing the communication between the ink unit and printer main unit in the anti-collision process.

FIG. 12 is a flow chart illustrating in detail the particulars of communication between an ink unit (specifically, the memory element 311) and the printer main unit (specifically, the transmitter/receiver 30) in the anti-collision process. This flow chart corresponds to the details of the first procedure illustrated in FIG. 8 (steps S1104 through S108). The example in FIG. 12 assumes that the transmitter/receiver 30 can communicate with two ink units INC1 and INC2. The left side of FIG. 12 shows the process procedure on the printer main unit side, and the middle and right sides show the process procedure for the first and second ink units, respectively.

When the anti-collision process is started, the transmitter/receiver 30 issues an anti-collision start command (step S11). When the two ink units INC1 and INC2 receive an anti-collision start command, the process for checking the ID proceeds between the transmitter/receiver 30 and the two ink units INC1 and INC2. Specifically, for example, the transmitter/receiver 30 searches the ID bit value in the two ink units INC1 and INC2, beginning from the lower bits of the ID. The ink units INC1 and INC2 send a response to the transmitter/receiver 30 when the searched bit values match their own ID bit values. In the example in FIG. 12, all the ID bit values of the first ink unit INC1 match those searched, and a response is thus sent to the transmitter/receiver 30. None of the ID bit values of the second ink unit INC2 match those searched, and thus no response is sent. The responses from the ink units are signals that do not include the ID information but merely indicate that a response is being made.

Methods of ink unit response which can be used include methods in which either an affirmative response (also referred to as "effective response") or negative response (also referred to as "ineffective response") is sent to the transmitter/receiver 30. In this case, the first ink unit INC1 sends an effective response, and the second ink unit INC2 sends an ineffective response. In the following description, however, the ink units simply respond or do not respond to notify the transmitter/receiver 30 whether the response is affirmative or negative.

Upon completion of the ID check of the first ink unit INC1, the ink unit INC1 automatically shifts to active mode M4 (FIG. 11), resulting in a state which will not accept subsequent anti-collision commands. The second ink unit INC2, on the other hand, automatically returns to hold mode M2. When the transmitter/receiver 30 receives a response from either ink unit indicating that the ID check is complete, the ID is stored as the ID of the first ink unit INC1 in the memory of the control circuit 50 (FIG. 6), and an anti-collision start command is re-issued as needed (step S112). At this time, the ink unit in hold mode M2 (the second ink unit INC2 in this example) receives the anti-collision start command and shifts to anti-collision mode M3, and the same anti-collision process as above is started.

In this way, the transmitter/receiver 30 can check the ID information of each ink unit. When the printer 10 is first powered on after being shipped (usually, when the printer is first switched on after being purchased), none of the ink unit ID have been checked, so it will be necessary to check the ID of all the ink units (the ID check process at this time is also referred to as the "full anti-collision process"). In that case, as illustrated in FIG. 9 above, the carriage 20 stops at a position where it can communicate with only the first ink unit INC1 to check the ID of the ink unit INC1. When the carriage 20 then moves to check the ID of the second ink unit INC2 (FIG. 9(*c*)), the first ink unit INC1 shifts to active mode M4 after the completion of the ID check. As a result, only the second ink unit INC2 is the object of the anti-collision process. When the ID of all the ink units has thus been checked, the transmitter/receiver 30 can determine to which ink unit the checked ID belongs, since only one ink unit is the object of the ID check.

Next, consider a case in which the ID has been checked in one of two ink units which can simultaneously shift to anti-collision mode M3, and only the ID of the other ink unit needs to be checked. In that case, when the two ink units are in hold mode M2, an active mode command including the ID of the first ink unit in which the ID has already been checked is issued from the transmitter/receiver 30, and the first ink unit shifts to active mode M4. Because the first ink unit will not receive commands for anti-collision processing while in active mode M4, the ID of only the second ink unit can be checked. In such a process, the transmitter/receiver 30 can simultaneously access three or more ink units, and can similarly do so even when the ID of only one of the ink units needs to be checked.

H. Details of Memory Access Process

Figure 13:
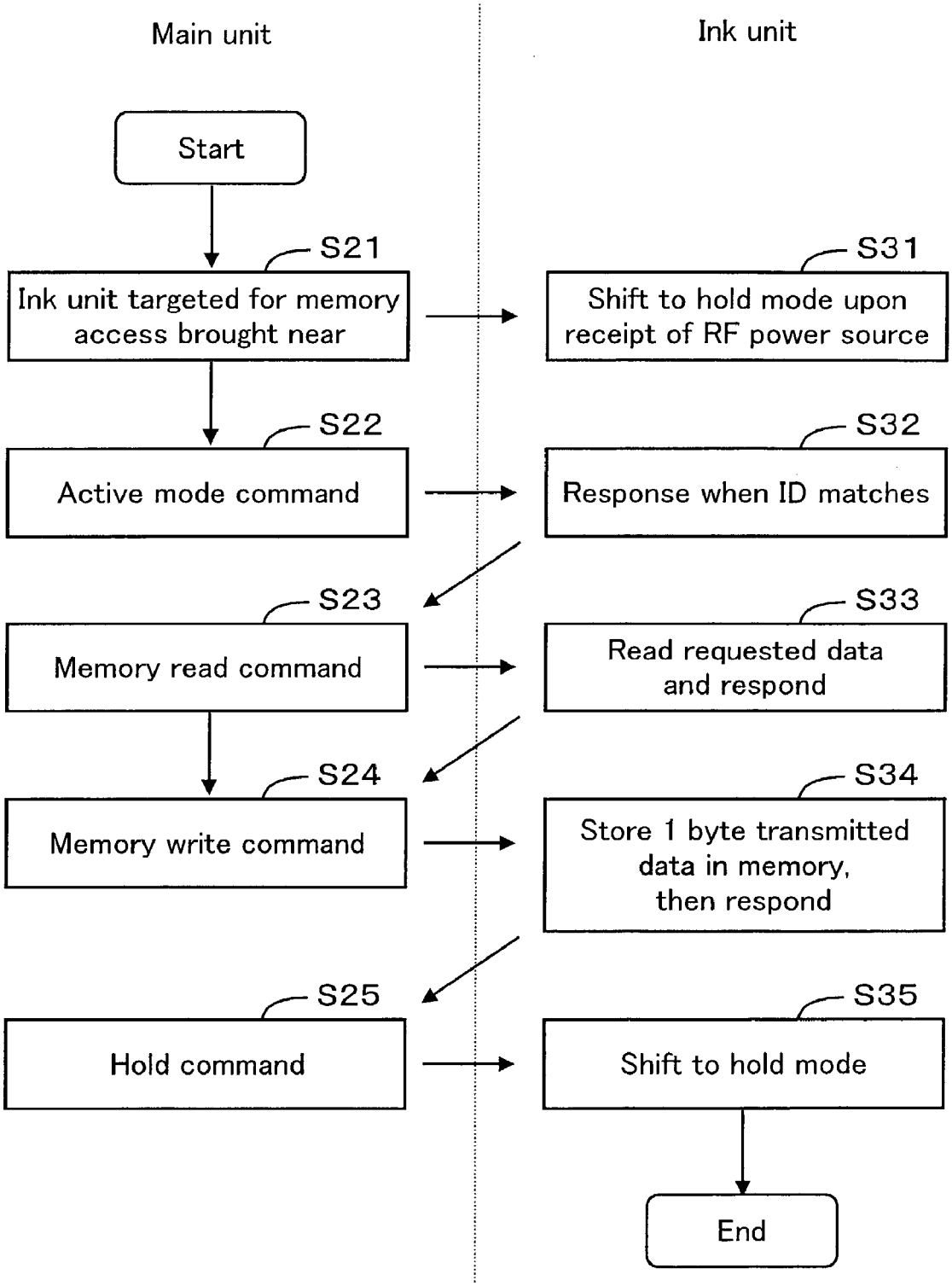
FIG. 13 is a flow chart detailing the communication between the ink unit and printer main unit in the memory access process.

FIG. 13 is a flow chart detailing the particulars of communication between the ink unit (specifically, the memory element 311) and the printer main unit (specifically, the transmitter/receiver 30) in the memory access process. This flow chart corresponds to the details of the second procedure shown in FIG. 8 (steps S200 through S204 or steps S206 through S210).

When memory access is started, the carriage 20 first moves and positions the ink unit targeted for memory access near the transmitter/receiver 30 (step S21), thus moving the ink unit into hold mode M2 (step S31). The transmitter/receiver 30 issues an active mode command including the ID in this state (step S22). When the ID contained in the active mode command matches the ID of the ink unit, the ink unit responds to the transmitter/receiver 30 and shifts to active mode 4 (step S32). As shown in FIG. 12, the active mode command includes all the ink unit ID information, thus allowing only one ink unit to shift to active mode M4. In another embodiment, the ink unit may shift to active mode M4 without responding to the transmitter/receiver 30 when the ID in the active mode command matches the ID of the ink unit.

When the response from the ink unit is received, the transmitter/receiver 30 issues either a memory read command or memory write command. In this example, a memory read command is first issued (step S23). The memory command includes the cartridge ID, read start address, and the read volume. When the ink unit receives the memory read command, it reads the designated read volume data beginning from the designated read start address, and responds to the transmitter/receiver 30 (step S33). The transmitter/receiver 30 issues further memory write commands as needed (step S24). The memory command includes the cartridge ID, write address, and data to be written. When the ink unit receives the memory write command, it writes data to the designated write address and then responds to the transmitter/receiver 30 (step S34). When the response is received, the transmitter/receiver 30 can check that the write has been properly completed. When the memory access process for the ink unit is completed, the transmitter/receiver 30 issues a hold command to the ink unit, allowing it to shift to hold mode M2 (steps S25 and S35). High frequency signals from the transmitter/receiver 30 may also be stopped to stop the operation of the memory element 311 after step S34 without going through steps S25 and S35.

In this way, when the memory access process is carried out, the transmitter/receiver 30 first issues an active mode command including the total ID to allow only one ink unit to shift to active mode M4. As a result, the memory access process can be carried out for just one ink unit, preventing accidental memory access of other ink units.

In cases where the transmitter/receiver 30 always limits the ink unit which can shift into active mode M4 to one, the ID of the memory access command (memory read command or memory write command) may be entirely omitted, and just a specific portion of the ID may be included. An advantage of including at least a portion of the ID in the memory access command is that memory access will be more reliable. Including only a specific portion of the ID in the memory access command can also increase the reliability of memory access while also simplifying the command structure.

Figure 14:
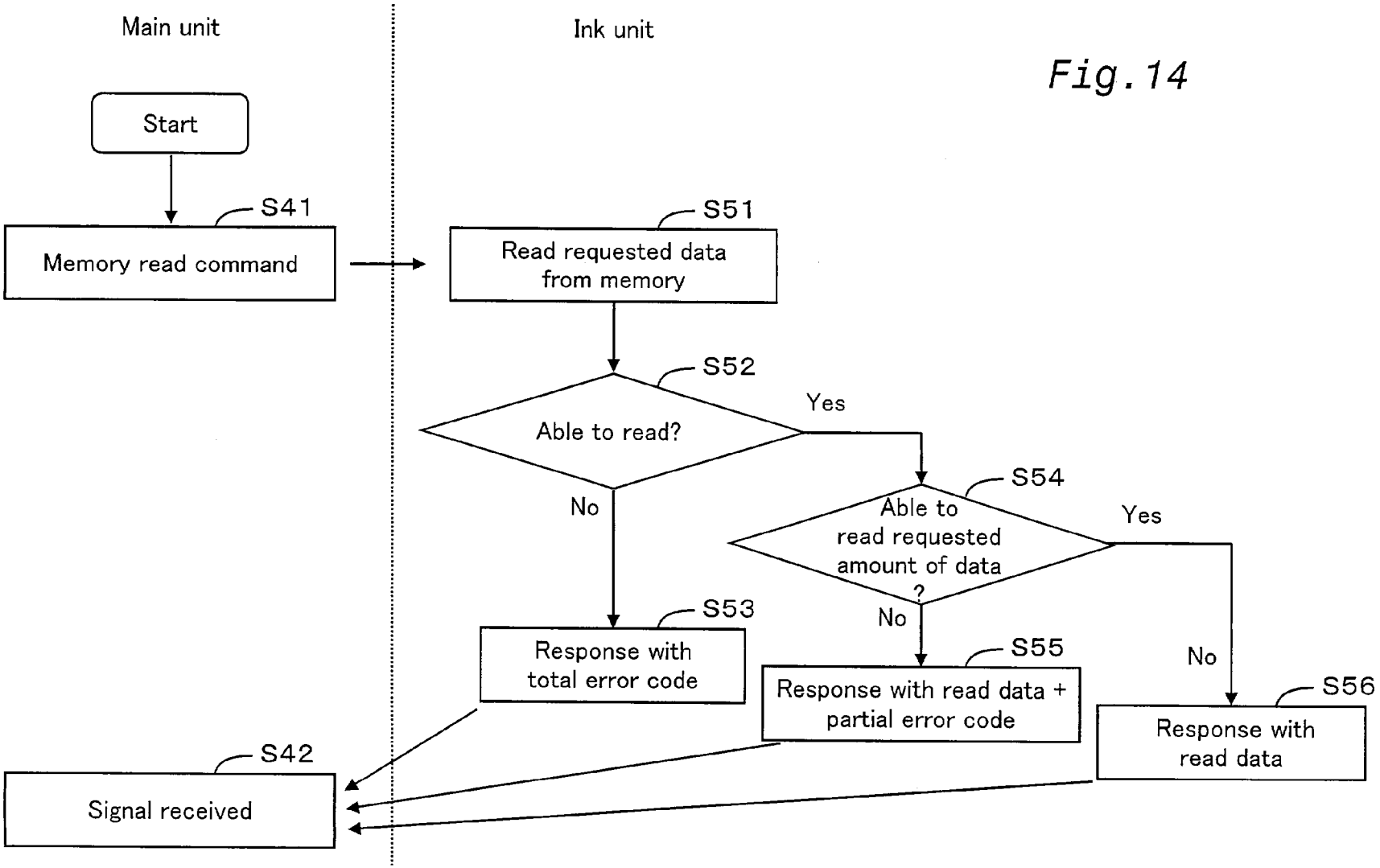
FIG. 14 is a flow chart detailing the process of reading from the memory element 311 (steps S23 and S33 in FIG. 14).

FIG. 14 is a flow chart detailing the reading process of the memory element 311 (steps S23 and S33 in FIG. 13). When the transmitter/receiver 30 issues a memory read command (step S41), the memory element 311 (FIG. 4) of the ink unit reads the designated number of bytes of data from the memory cell 3117 (step S51). When no data can be read at such times, the memory element 311 transmits a specific error code indicating a data read failure (referred to as "total error code") to the transmitter/receiver 30 (steps S52 and S53). When only some of the designated number of bytes have been read, an error code indicating that some of the data have not been read ("partial error code") is sent along with the read data to the transmitter/receiver 30 (steps S54 and S55). When all the designated bytes of data have been read, the data are sent to the transmitter/receiver 30 (step S56). In another embodiment, the transmitter/receiver 30 may send a memory read command containing an ID, and the memory element 311 of the ink unit may judge if the ID matches that of the ink unit and carry out the processing of step S51 and thereafter only when the IDs are the same. In this case, the memory element 311 will not respond to the transmitter/receiver 30 if the IDs are different.

Because the transmitter/receiver 30 receives the response results, the appropriate process can be run in accordance therewith (step S42). For example, when a response including an error code is received, the same memory read command can be reissued to allow the memory element 311 to read the data. When a response including a partial error code is received, just the received data is transmitted along with the partial error code to the control circuit 50 in the main unit (FIG. 6) to proceed to the next process.

Figure 15:
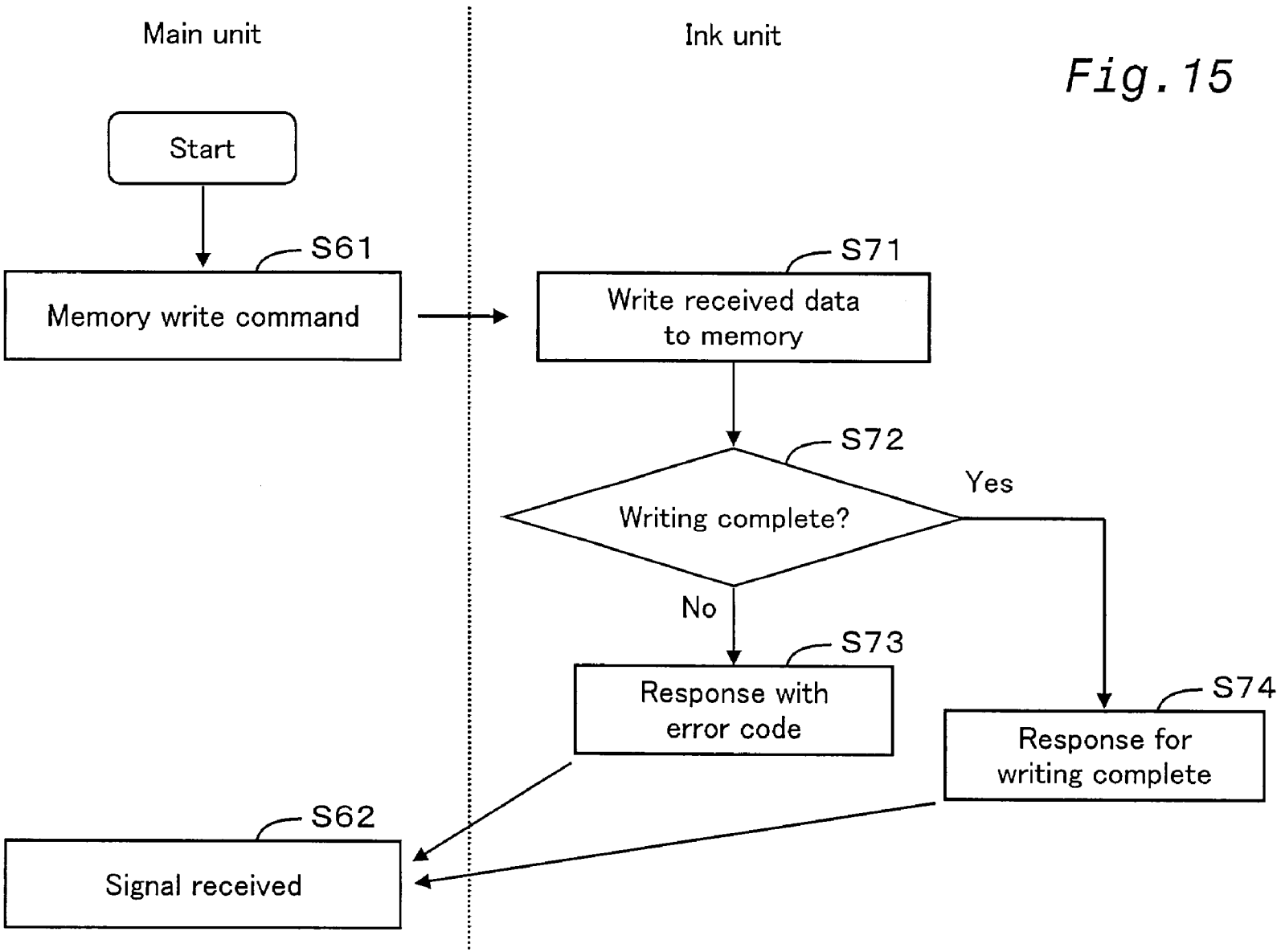
FIG. 15 is a flow chart detailing the process of writing to the memory element 311 (steps S24 and S34 in FIG. 14).

FIG. 15 is a flow chart detailing the processing of writing to the memory element 311 (steps S24 and S34 in FIG. 13). When the transmitter/receiver 30 issues a memory write command (step S61), The memory element 311 of the ink unit writes data included in the memory write command to the memory cell 3117 (step S71). When no data are written, the memory element 311 sends a specific error code indicating the data write failure to the transmitter/receiver 30 (steps S72 and S73). When the data have been successfully written, a response indicating the successful write is sent to the transmitter/receiver 30 (step S74). The transmitter/receiver 30 receives the response results, allowing the appropriate process to be run in accordance therewith (step S62). For example, when a response including an error code is received, the same memory write command can be re-issued to run the data writing process again. In another embodiment, the transmitter/receiver 30 may send a memory write command containing an ID in the writing operation as in the reading operation. In this case, the memory element 311 of the ink unit judges whether the ID matches that of the ink unit and carries out the processing of step S71 and thereafter only when the IDs are the same. The memory element 311 will not respond to the transmitter/receiver 30 if the IDs are different.

I. Variants in Flow of Communication Between Printer Main Unit and Memory Element.

By way of example, and not limitation, additional embodiments of the present invention will now be described.

Figure 16:
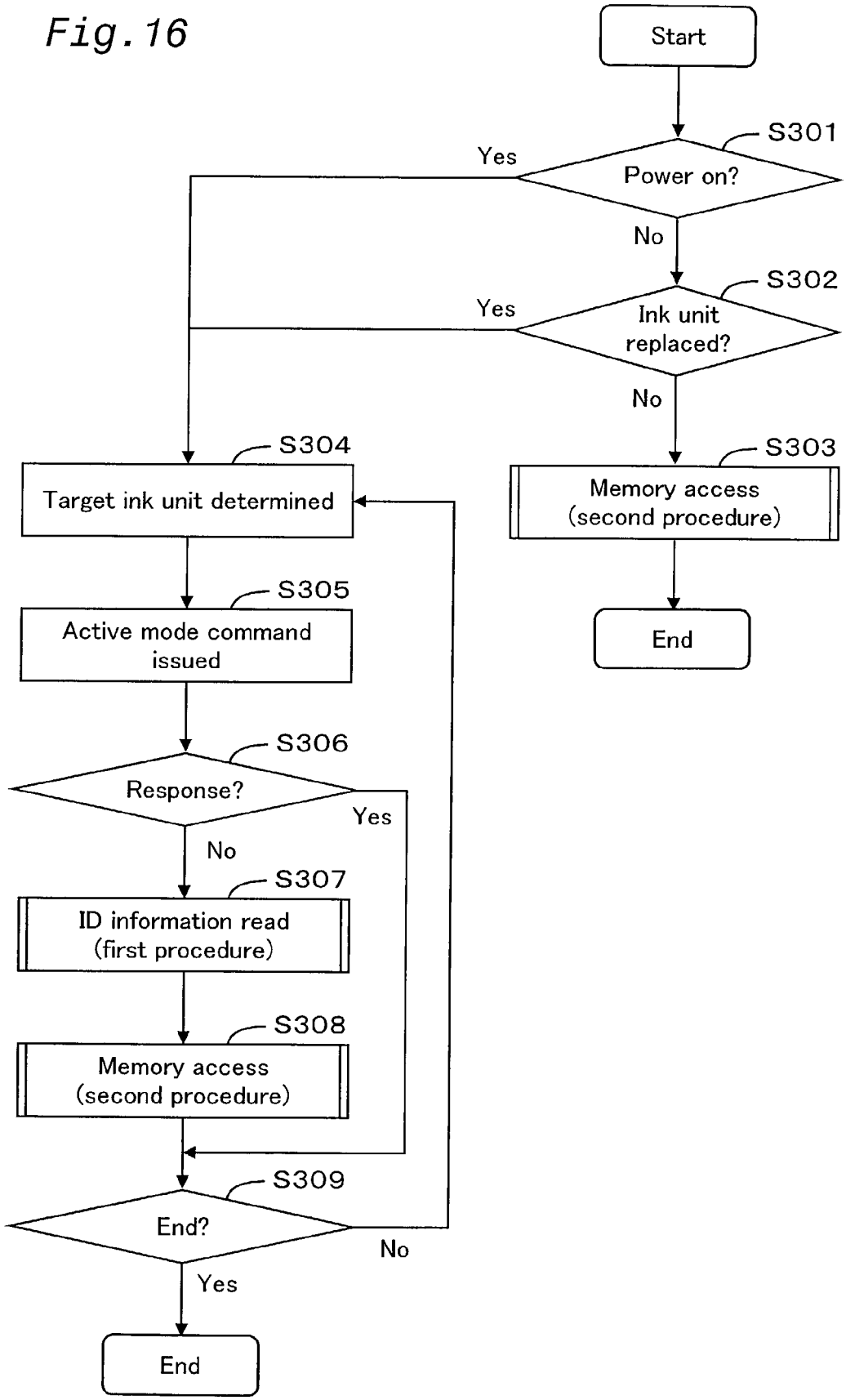
FIG. 16 is a flow chart showing another example of the flow of communication between the memory element and printer main unit illustrated in FIG. 8.

FIG. 16 is a flow chart showing another example of the flow of communication between the memory elements and the printer main unit illustrated in FIG. 8. When the power is on and none of the ink units have been replaced, an active mode command is issued to run memory access (second procedure) in the same manner as in FIG. 8, and will thus not be described here again.

In the flow in FIG. 16, when the power is on or an ink unit has been replaced, the ink unit targeted for ID information check is first determined (step S304). For example, out of the six ink units INC1 through INC6, the first ink unit INC1 is the target ink unit. The transmitter/receiver 30 issues an active mode command to the target ink unit (step S305). The active mode command includes the ID information of the first ink unit INC1 which have been registered in the control circuit 50 (FIG. 6) of the printer main unit. When there is a response from the target ink unit INC1 regarding the active mode command, the ID check of the target ink unit INC1 is complete. The transmitter/receiver 30 then moves from step S306 to step S309 to determine whether or not the process is complete for all the cartridges. If it is determined that the process is not complete in step S309, the process returns to step S304, and the next ink unit INC2 is selected as the target ink unit.

In this way, in the routine involving steps S304 through S306 and S309, the target ink unit is selected one at a time beginning from the first ink unit, and the transmitter/receiver 30 issues an active mode command using the registered ID information relating to the target ink unit. When there is no response from the target ink unit, the ID information relating to the ink unit must be checked, so the ID information is read (first procedure) and the memory is accessed (second procedure), as illustrated in FIG. 8, in steps S307 and S308. In the memory access process, data regarding the amount of ink remaining (amount of consumable component remaining) in the ink unit, for example, can be read, and data for increasing by one the number of ink units which have been replaced can be written. In this example, it is assumed that data indicating the amount of ink remaining and the number of ink units that have been replaced can be stored in the memory cell 3117. As such, the process from steps S304 through S308 is repeated until the ID information relating to all the ink units have been checked (step S309).

An advantage of the process procedure in FIG. 16 is that the time needed for the process as a whole can be shortened because the anti-collision process is run only for ink units in which the ID information has not been checked, with no need to run the anti-collision process for all of the ink units INC. The anti-collision process procedure itself can be simplified by running the anti-collision process for all the ink units according to the operations in FIG. 9, even when ink units are replaced.

As will be apparent from the foregoing description, the anti-collision process (ID check in anti-collision mode M3) should be run for at least the replaced ink units after any of the ink units in the printer have been replaced.

Depending on the device, a structure may be provided to determine the position of the replaced ink unit after any of the ink units have been replaced. In this type of device, the transmitter/receiver 30 may be brought near just the replaced ink unit to check the ID in anti-collision mode, without any need for checking the ID of the other ink units.

When the device is powered on for the first time after being shipped, the first procedure should be immediately started to check the ID, as in the process shown in FIG. 8. The second time and thereafter that the power is turned on after the device has been shipped, an active mode command should be issued by the transmitter/receiver 30 to each ink unit, as in the process procedure in FIG. 16, to check the ID in anti-collision mode M3 only for those cartridges which do not give a response.

J. Other Variants

A printer device and the like relating to the present invention are illustrated above based on some preferred embodiments, and the above embodiments of the invention are intended to facilitate an understanding of the invention, and do not limit the invention. Various modifications and improvements are possible within the scope of the present invention, such equivalent products [naturally] being included in the present invention.

J1. Variant 1

By way of non-limiting example, this invention can be practiced using a computer system having a computer main unit, display device connected to the computer main unit, printer relating to the above embodiments connected to the computer main body, input device such as mouse or keyboard provided as needed, floppy disk drive device, and CD-ROM drive device. Such a computer system will be a better system than conventional systems as such as system overall.

J2. Variant 2

The printer in the above embodiments may have at least some of the functions of a computer main unit, display device, input device, floppy disk drive device, and CD-ROM drive device. For example, the printer may have an image processor for processing images, a display for various types of display, and a recording media insertion/removal component for receiving and ejecting recording media on which are recorded image data taken by means of digital cameras or the like.

J3. Variant 3

Although an ink jet printer 10 employing cut paper as the printing object was used as the printer in the above embodiments, printing objects other than cut paper, such as roll paper, film and textiles can also be used. The printer is also not limited to color ink jet printers. For example, monochromatic printers, laser printers, and faxes are applicable, provided that the printer is capable of printing such printing objects.

J4. Variant 4

The memory element used in the above embodiments has a non-contact IC chip, a resonance capacitor formed by etching a metal film, and a flat antenna coil, but is not limited to such a structure, and contemplates any structures capable of recording data. For example, a resonance capacitor may be connected to the outside of the memory element, J5. Variant 5

In the above embodiments, three modes including hold mode M2, anti-collision mode M3, and active mode M4 were used as modes during the operation of the memory element, but the memory element 311 may also have other modes. For example, hold mode M2 can be divided into a plurality of hold sub-modes. More specifically, the reception of a high frequency signal from the transmitter/receiver 30 can result in a shift to a first hold sub-mode, and the reception of a specific shift command in the first hold sub-mode can result in a shift to a second hold sub-mode. At that time, when the memory element receives an active mode command while in the first hold sub-mode, it should move immediately to the active mode M4, and when it receives an anti-collision start command while in the second hold sub-mode, it should move immediately to anti-collision mode M3. In this structure, an anti-collision process malfunction will result in a return to the second hold sub-mode, while the receipt of a hold command will result in a shift from the active mode M4 to the first hold sub-mode. The use of such a hold mode structure can limit the shifts between operating modes, and can thus prevent accidental shifts to inappropriate operating modes. That is, the advantage is the ability to ensure more reliable shifts between operating modes.

Alternatively, the memory element does not need to have a hold mode. For example, the memory element can be designed to shift immediately to active mode when power is generated upon receipt of a high frequency signal from the transmitter/receiver. The memory element can also be designed to shift from a specific mode other than anti-collision mode or active mode to active mode without going through anti-collision mode. That is, the memory element (memory circuit) of the present invention may generally be able to shift from a specific state that is not in anti-collision mode to active mode without going through anti-collision mode. However, it is presently preferable that the memory element shifts to active mode upon receipt of an active mode command including the ink unit ID. Furthermore, the memory element may preferably shift from hold mode to active mode when receiving a read command or write command containing the ink unit ID in hold mode, so as to carry out reading or writing operations.

J6. Variant 6

The embodiments above illustrate a printer in which ink units can be installed, but the present invention is not limited thereto and is generally applicable to a variety of devices in which cartridges with consumable components can be installed. The device does not have to be one in which a plurality of cartridges, each with a consumable component, are installed, but should allow at least one cartridge with a consumable component to be installed. In the above embodiments, cartridges, each with a consumable component, were moved along with the carriage (cartridge holder). Alternatively, the transmitter/receiver may be moved. The positional relationship between the transmitter/receiver and cartridge may also be fixed, with neither the main unit transmitter/receiver nor cartridge being moved.

J7. Variant 7

In the above embodiments, the transmitter/receiver 30 and ink unit were within a specific distance of no more than about 30 mm of each other while communicating, but the outer surface of the cartridge and the transmitter/receiver may generally be in contact during communication. That is, the transmitter/receiver and cartridge should be capable of non-contact communication while adjacent to each other. In the present Specification, the expression concerning "non-contact" between the transmitter/receiver and cartridge means that the electric circuitry of the transmitter/receiver and the electrical circuitry of the cartridge are not connected by electrical wiring, even when outer surfaces are in contact with each other. In other words, physical contact does not itself result in electrical contact.

J8. Variant 8:

In the above embodiments, the transmitter/receiver 30 allowed two ink units to simultaneously shift into hold mode, but the transmitter/receiver can generally have the capacity of simultaneously moving two or more cartridges to hold mode. However, the transmitter/receiver should not have the capacity of simultaneously moving all of the maximum number of cartridges which can be mounted into hold mode. That is because it would be difficult to distinguish the position of each cartridge in the anti-collision process (ID check process) if the transmitter/receiver had the capacity to simultaneously move all the cartridges into hold mode. In that sense, it is particularly desirable for the transmitter/receiver to have the capacity of simultaneously moving one or two cartridges into hold mode.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A device for receiving a plurality of cartridges each for containing a consumable component, the device comprising:

a movable cartridge holder that mounts the cartridges, respectively containing the consumable components; and a transmitter/receiver for non-contact communication with the cartridge while proximate to the cartridge, wherein the cartridge holder is movable relative to the transmitter/receiver during operation of the device to bring each of the cartridges proximate to the transmitter/receiver, wherein each of the cartridges has a memory circuit including an antenna for non-contact communication with the transmitter/receiver while proximate to the transmitter/receiver, a memory for storing an ID of the cartridge and data relating to the consumable component, and a controller for controlling communication with the transmitter/receiver and for controlling access to the memory, the memory circuit having an anti-collision mode in which the transmitter/receiver checks the ID of the cartridge, and an active mode permitting memory access upon reception of a memory access command from the transmitter/receiver, the memory circuit shifting from a specific state which is not in anti-collision mode to the active mode without passing through the anti-collision mode, and wherein the memory circuit receives power from the transmitter/receiver only when brought proximate to the transmitter/receiver within an entire movable range of the memory circuit along with the cartridge movement, while the memory circuit does not receive power from the transmitter/receiver when brought far from the proximity of the transmitter/receiver within the entire movable range of the memory circuit.

2. A device according to claim 1, wherein the memory circuit shifts to the active mode without passing through the anti-collision mode upon receipt of an active mode command including the ID of the cartridge while not in the anti-collision mode.

3. A device according to claim 1, wherein after the ID has been checked in the anti-collision mode the memory circuit shifts to the active mode.

4. A device according to claim 3, wherein the memory circuit has a hold mode in which the memory circuit cannot receive memory access commands, and when in the hold mode, the memory circuit, upon receipt of the active mode command, shifts to the active mode.

5. A device according to claim 4, wherein the memory circuit has an electrical power generating component for generating an electrical power output for the memory circuit in response to high frequency radio signals received from the transmitter/receiver, the hold mode including a first hold sub-mode in which the electrical power output is generated in the memory circuit in response to the high frequency radio signals received from the transmitter/receiver, and a second hold sub-mode to which the memory circuit, in the first hold sub-mode, shifts upon receiving a predetermined shift command from the transmitter/receiver, the memory circuit, when in the first hold sub-mode, shifts directly to the active mode upon receipt of the active mode command, and the memory circuit, when in the second hold sub-mode, shifts directly to the anti-collision mode upon receipt of an anti-collision start command.

6. A device according to claim 4, wherein, when the device is first powered on after being shipped, the device carries out a full cartridge anti-collision process in which the ink cartridges that have been mounted are sequentially caused, one at a time, to approach the transmitter/receiver, and in which the ID of each cartridge is checked in the anti-collision mode while a target cartridge targeted for ID check is positioned such that the transmitter/receiver determines the position of the target cartridge.

7. A device according to claim 6, wherein the full cartridge anti-collision process is carried out each time the device is powered on.

8. A device according to claim 6, wherein, when the device is powered on for the second time or thereafter after being shipped, the active mode command is transmitted by the transmitter/receiver to each cartridge , and the ID is checked in the anti-collision mode only for those of the cartridges which have not made an effective response to the active mode command.

9. A device according to claim 4, wherein after any of the cartridges installed in the device have been replaced, the ID of at least the replaced cartridge is checked in the anti-collision mode.

10. A device according to claim 9, further comprising a drive mechanism that moves one of the cartridge holder and the transmitter/receiver to bring the cartridges and transmitter/receiver proximate to each other, and wherein, after any of the cartridges installed in the device have been replaced, the full anti-collision process is carried out, in which the mounted cartridges are sequentially allowed, one at a time, to approach the transmitter/receiver, and the ID of each cartridge is checked while the transmitter/receiver determines the position of the target cartridges targeted for ID check in the anti-collision mode.

11. A device according to claim 9, further comprising a drive mechanism that moves one of the cartridge holder and the transmitter/receiver to bring the cartridges and transmitter/receiver proximate to each other, and the transmitter/receiver, after any of the cartridges installed in the device have been replaced, approaches only the replaced cartridges, so as to check the ID in the anti-collision mode without checking the ID of the other cartridges.

12. A device according to claim 11, wherein, after any of the cartridges in the device have been replaced the active mode command is transmitted near each cartridge installed in the device, and the ID is checked in the anti-collision mode only for cartridges which have not made an effective response.

13. A device according to claim 4, wherein the transmitter/receiver simultaneously shifts at least two cartridges into the hold mode, but does not simultaneously shift all of the maximum number of cartridges which can be installed in the device into the hold mode.

14. A cartridge for containing a consumable component, a plurality of the cartridges to be mounted in a cartridge holder of a printer having a transmitter/receiver, the cartridge comprising:

a memory circuit including an antenna for non-contact communication with the transmitter/receiver while proximate to the transmitter/receiver, a power circuit for generating power from signals received by the antenna, a memory for storing an ID of the cartridge and data relating to the consumable component, and a controller for controlling communication with the transmitter/receiver and for controlling access to the memory, the memory circuit having an anti-collision mode in which the transmitter/receiver checks the ID of the cartridge, and an active mode permitting memory access upon reception of a memory access command from the transmitter/receiver, the memory circuit shifting from a specific state which is not in anti-collision mode to the active mode without passing through the anti-collision mode, wherein the cartridge holder is movable relative to the transmitter/receiver during operation of the printer to bring the cartridge proximate to the transmitter/receiver, wherein the antenna and the power circuit are constructed to receive power from the transmitter/receiver only when the memory circuit is brought proximate to the transmitter/receiver within an entire movable range of the memory circuit along with the cartridge movement, while the antenna and the power circuit do not receive power from the transmitter/receiver when the memory circuit is brought far from the proximity of the transmitter/receiver within the entire movable range of the memory circuit, wherein after the ID has been checked in the anti-collision mode the memory circuit shifts to the active mode, wherein the memory circuit further comprises a hold mode in which the memory circuit cannot receive memory access commands, and when in the hold mode, the memory circuit, upon receipt of the active mode command, shifts to the active mode, and wherein the memory circuit further comprises an electrical power generating component for generating an electrical power output for the memory circuit in response to high frequency radio signals received from the transmitter/receiver, the hold mode including a first hold sub-mode in which the electrical power output is generated in the memory circuit in response to the high frequency radio signals received from the transmitter/receiver, and a second hold sub-mode to which the memory circuit, in the first hold sub-mode, shifts upon receiving a predetermined shift command from the transmitter/receiver, the memory circuit, when in the first hold sub-mode, shifts directly to the active mode upon receipt of the active mode command, and the memory circuit, when in the second hold sub-mode, shifts directly to the anti-collision mode upon receipt of an anti-collision start command.

15. A method for identifying a cartridge containing a consumable component and having an element for storing data, a plurality of the cartridges being mountable in a movable cartridge support member of a device having a device main unit, the element being subject to data read or data write operation through non-contact communication between the element and a communication device provided in the device main unit, the cartridge support member being movable relative to the communication device during operation of the device, comprising the steps of:

performing, using the device main unit, a first procedure in which the communication device communicates with the element of each of the cartridges to read ID information stored in the element, the first procedure placing the element into an anti-collision mode; and performing, using the device main unit, a second procedure in which the communication device communicates with the element of each of the cartridges disposed on the cartridge support member while distinguishing each of the elements based on the ID information that has been read, the second procedure placing the element into an active mode, wherein the second procedure is run without the first procedure being run if the ID information stored in the element of a particular cartridge has already been properly read by the device main unit when the communication device staffs communicating with the element, so that the element and the communication device communicate with each other while the element is distinguished based on the ID information, wherein the element for storing data shifts from a specific state which is not in the anti-collision mode to the active mode without passing through the anti-collision mode, and wherein the element receives power from the communication device only when brought proximate to the communication device within an entire movable range of the memory circuit along with the cartridge movement, while the memory circuit does not receive power from the transmitter/receiver when brought far from the proximity of the transmitter/receiver within the entire movable range of the memory circuit.

16. A method of identifying a plurality of ink units in a printer, comprising the steps of:

providing the printer, the printer having a plurality of ink units equipped, respectively, with elements capable of for storing data, a movable ink unit support member for supporting the plurality of ink units, and a communication device for reading or writing data by non-contact communication with the elements, the ink unit support member being movable relative to the communication device during operation of the printer;

performing a first procedure in which the communication device communicates with the element of each said ink unit to read ID information stored in the element, the first procedure placing the element into an anti-collision mode; and performing a second procedure in which the communication device communicates with the element of each said ink unit supported by the movable ink unit support member while distinguishing the element based on the ID information that has been read, the second procedure placing the element into an active mode, wherein the second procedure is run without the first procedure being run if the ID information stored in the element of a particular said ink unit has already been properly read when the communication device staffs communicating with the element, so that the communication device communicates with the element, wherein the element for storing data shifts from a specific state which is not in the anti-collision mode to the active mode without passing through the anti-collision mode, and wherein the element receives power from the communication device only when brought proximate to the communication device within an entire movable range of the memory circuit along with the cartridge movement, while the memory circuit does not receive power from the transmitter/receiver when brought far from the proximity of the transmitter/receiver within the entire movable range of the memory circuit.

17. A method according to claim 16, wherein the ink units are detachable from the ink unit support member.

18. A method according to claim 17, wherein after the ID information stored in the elements in each of the ink units has been read upon execution of the first procedure, the second procedure is run without the first procedure being run as long as power-off and power-on of the printer are not carried out and none of the ink units has been replaced, allowing the communication device to communicate with the elements.

19. A method according to claim 16, wherein the ID information is element-specific data stored in the element before the element is attached to the ink unit.

20. A method according to claim 16, wherein the ink unit support member is movable, and the element provided in each of the ink units receives power from the printer only when brought proximate to the communication device by movement of the ink unit support member.

21. A method of identifying a plurality of ink units in a printer, comprising the steps of:

providing the printer, the printer having a movable ink support member and a printer main unit having a communication device, the ink unit support member being movable relative to the communication device during operation of the printer;

providing the ink units, each said ink unit having an element for storing data, the ink units being mounted in the movable ink unit support member, the element being subject to a data read operation or a data write operation through non-contact communication between the element and the communication device;

performing a first procedure in which the communication device communicates with the element of each said ink unit to read ID information stored in the element, the first procedure placing the element into an anti-collision mode; and performing a second procedure in which the communication device communicates with the element of each said ink unit disposed on the movable ink unit support member while distinguishing each said element based on the ID information that has been read, the second procedure placing the element into an active mode, wherein the second procedure is run without the first procedure being run if the ID information stored in the element of a particular said ink unit has already been properly read by the printer main unit when the communication device starts communicating with the element, so that the element and the communication means device communicate with each other as the element is distinguished based on the ID information, wherein the element for storing data shifts from a specific state which is not in the anti-collision mode to the active mode without passing through the anti-collision mode, and wherein the element receives power from the communication device only when brought proximate to the communication device within an entire movable range of the memory circuit along with the cartridge movement, while the memory circuit does not receive power from the transmitter/receiver when brought far from the proximity of the transmitter/receiver within the entire movable range of the memory circuit.

22. A method according to claim 21, wherein the ink unit is detachable from the ink unit support member.

23. A method according to claim 21, wherein the ID information are element-specific data stored in the elements before the elements are attached to the ink units.

24. A method according to claim 21, wherein the ink unit support member is movable, and the element of the ink unit receives power from the printer main unit only when brought proximate to the communication device by movement of the ink unit support member.

25. A method according to claim 21, wherein the ID information comprises manufacturing data for the ink units.

26. A method according to claim 25, wherein the manufacturing data include data for specifying a year in which the ink unit was manufactured.

27. A method according to claim 25, wherein the manufacturing data include data for specifying a month in which the ink unit was manufactured.

28. A method according to claim 25, wherein the manufacturing data includes data for specifying a day on which the ink unit was manufactured.

29. A method according to claim 25, wherein the manufacturing data includes data for specifying a location where the ink unit was manufactured.

30. A method according to claim 25, wherein the element comprises a writable area where the printer main unit can write data and a nonwritable area where the printer main unit cannot write data, and the manufacturing data are stored in the nonwritable area.

31. A method according to claim 25, wherein a plurality of the ink units are mounted on the unit support member provided in the printer main unit, the ID information stored in the elements of the ink units is read in a non-contact manner by the communication device provided in the printer main unit, and a relationship between a layout sequence of the ink units on the ink unit support member and the ID information stored in the elements provided in the ink units is specified by the printer main unit.

32. A method of identifying a plurality of ink units in a printer, comprising the steps of:

providing the plurality of ink units respectively equipped with elements for storing data, providing the printer, the printer having a movable ink unit support member for supporting the plurality of ink units, the ink units being detachable from the ink unit support member, and a communication device for reading or writing data by non-contact communication with the elements, the ink unit support member being movable relative to the communication device during operation of the printer, and the element provided in each said ink unit receives power from the printer only when brought proximate to the communication device by a movement of the ink unit support member;

performing a first procedure in which the communication device communicates with the element of each said ink unit to read ID information stored in the element, wherein the ID information is element-specific data stored in the element before the element is attached to the ink unit, the first procedure placing the element into an anti-collision mode, and performing a second procedure in which the communication device communicates with the element of each said ink unit supported by the ink unit support member while distinguishing the element based on the ID information that has been read, the second procedure placing the element into an active mode, wherein, after the ID information stored in the elements in each said ink unit has been read upon execution of the first procedure, the second procedure is run without the first procedure being run as long as power-off and power-on of the printer are not carried out and none of the ink units has been replaced, allowing the communication device to communicate with the elements, wherein the element for storing data shifts from a specific state which is not in the anti-collision mode to the active mode without passing through the anti-collision mode, and wherein the element for storing data receives power from the communication device only when brought proximate to the communication device within an entire movable range of the memory circuit along with the cartridge movement, while the memory circuit does not receive power from the transmitter/receiver when brought far from the proximity of the transmitter/receiver within the entire movable range of the memory circuit.

* * * * *